US012703411B2

(12) United States Patent
Mallampati et al.

(10) Patent No.: US 12,703,411 B2
(45) Date of Patent: Aug. 11, 2026

(54) SYSTEM AND METHOD FOR MANAGING HOSTLER-AIDED MULTI-HOP OPERATIONS TO REPAIR DEVIATIONS IN EXECUTION OF OPTIMIZED OPERATING SCHEDULES ASSOCIATED WITH A HUB

(71) Applicant: BNSF Railway Company, Fort Worth, TX (US)

(72) Inventors: Dasaradh R. Mallampati, Trophy Club, TX (US); Vishal Badyal, Haslet, TX (US); Paul Kuhn, Fort Worth, TX (US); April Y. Kuo, Colleyville, TX (US)

(73) Assignee: BNSF Railway Company

( * ) Notice: Subject to any disclaimer, the term of this patent is extended or adjusted under 35 U.S.C. 154(b) by 19 days.

(21) Appl. No.: 18/911,477

(22) Filed: Oct. 10, 2024

(65) Prior Publication Data

US 2025/0145194 A1 May 8, 2025

Related U.S. Application Data

(63) Continuation-in-part of application No. 18/501,608, filed on Nov. 3, 2023, now Pat. No. 12,217,199.

(51) Int. Cl.
*B61L 27/16* (2022.01)
*B61L 25/06* (2006.01)
*B61L 27/04* (2006.01)

(52) U.S. Cl.
CPC ..... *B61L 27/16* (2022.01); *B61L 25/06* (2013.01); *B61L 27/04* (2013.01)

(58) Field of Classification Search
CPC ..... B61L 27/16; B61L 25/06; B61L 27/04; B61L 27/14; B61L 27/12; G06Q 10/063; G06Q 10/08
See application file for complete search history.

(56) References Cited

U.S. PATENT DOCUMENTS 9,123,239 B2 9/2015 Kurzhanskiy
10,943,318 B2 3/2021 Benedict
(Continued)

FOREIGN PATENT DOCUMENTS

CA 3153593 A1 3/2021
WO 2024025863 A1 2/2024
WO WO-2024049818 A1 * 3/2024 ..... H03M 1/822

OTHER PUBLICATIONS

Tomas Liden, Coordinating maintenance windows and train trafc: a case study, Case Study and Applications, Accepted: Feb. 12, 2020 / Published online: Apr. 26, 2020. (Year: 2020).
(Continued)

*Primary Examiner* — Long T Tran
*Assistant Examiner* — Charles J Brauch
(74) *Attorney, Agent, or Firm* — Enrique Sanchez, Jr.; Juan J Vasquez

(57) ABSTRACT

Systems and techniques for intelligently repairing deviations in the execution of an optimized operating schedule associated with a hub. In embodiments, intelligently repairing deviations in the execution of an optimized operating schedule associated with a hub may include managing hostler-aided multi-hop operations that may be configured to repair the impact of mis-located units within the hub by optimizing the use of hostler resources during execution of the optimized operating schedule to insert multihop operations configured to move or transport the mis-located units from suboptimal locations to optimal locations into hostler route operations, which may improve or reoptimize the unit throughput within the hub over the planning horizon of the optimized operating schedule. In embodiments, an optimal location includes a location that leads to a higher unit throughput for the hub when the unit is located therein than when the unit is located in the current mis-location.

20 Claims, 11 Drawing Sheets

(56) References Cited

U.S. PATENT DOCUMENTS

| | | | |
|---|---|---|---|
| 11,948,109 | B1 | 4/2024 | Kriett |
| 2002/0082814 | A1 | 6/2002 | Doner |
| 2002/0082893 | A1 | 6/2002 | Barts et al. |
| 2004/0034556 | A1 | 2/2004 | Matheson |
| 2004/0039597 | A1 | 2/2004 | Barts et al. |
| 2007/0156308 | A1 | 7/2007 | Muinonen |
| 2014/0236957 | A1 | 8/2014 | Rieppi |
| 2016/0342933 | A1 | 11/2016 | Johnson et al. |
| 2017/0228566 | A1 | 8/2017 | Sengstaken, Jr. |
| 2019/0287066 | A1 | 9/2019 | Kellaway, Jr. et al. |
| 2021/0272065 | A1 | 9/2021 | Sakakibara et al. |
| 2021/0398074 | A1 | 12/2021 | Bollapragada |
| 2023/0007439 | A1 | 1/2023 | Williams et al. |
| 2023/0028672 | A1 | 1/2023 | Oren et al. |
| 2023/0088950 | A1 | 3/2023 | Paula et al. |
| 2024/0317285 | A1 | 9/2024 | Malde |
| 2024/0354635 | A1 | 10/2024 | Davaloo et al. |
| 2025/0002062 | A1 | 1/2025 | Liu et al. |

OTHER PUBLICATIONS

Heydari Ruhollah et al: "A path-based capacitated network flow model for empty railcar distribution", Annals of Operations Research, Springer US, New York, vol. 253, No. 2, Sep. 6, 2016 (Sep. 6. 2016), pp. 773-798, XP036260224, ISSN: 0254-5330, DOI: 10.1007/S10479-016-2259-4 [retrieved on Sep. 6, 2016].

Sarosky T et al: "Simulation of a Railroad Intermodal Terminal", Proceedings of the Winter Simulation Conference (WSC). Lake Buena Vista, Dec. 11-14, 1994; [Proceedings of the Winter Simulation Conference (WSC)], New York, IEEE, US, Dec. 11, 1994 (Dec. 11, 1994), pp. 1233-1238, XP000536746, ISBN: 978-0-7803-2109-0.

Natalia Kliewer, Taieb Mellouli, Leena Suhl, A time-space network based exact optimization model for multi-depot bus scheduling, European Journal of Operational Research, vol. 175, Issue 3, 2006 (Year: 2006).

* cited by examiner

SYSTEM AND METHOD FOR MANAGING HOSTLER-AIDED MULTI-HOP OPERATIONS TO REPAIR DEVIATIONS IN EXECUTION OF OPTIMIZED OPERATING SCHEDULES ASSOCIATED WITH A HUB

CROSS-REFERENCE TO RELATED APPLICATIONS

The present application is a continuation-in-part of pending and co-owned U.S. patent application Ser. No. 18/501,608, entitled "SYSTEMS AND METHODS FOR INTERMODAL DUAL-STREAM-BASED RESOURCE OPTIMIZATION", filed Nov. 3, 2023, the entirety of which is herein incorporated by reference for all purposes.

TECHNICAL FIELD

The present disclosure relates generally to resource optimization systems, and more particularly to systems and devices for intelligently repairing deviations in the execution of an optimized operating schedule associated with a hub.

BACKGROUND

Transportation hubs enable the coordination for goods to be received, securely stored, systematically sorted, and expediently loaded for delivery. In particular, intermodal hub facilities (IHFs) epitomize this role, functioning as critical junctures where units, typically containers bearing goods, are transitioned between different transportation modes including, but not limited to, rail, road, maritime, and aerial transport. These hubs are characterized by their capabilities to handle and process units that are designed for multi-modal transport, and in this manner serving as integral nodes in transportation networks. The operational context of an IHF is complex and dynamic.

Operations of an IHF can be conceptualized as having distinct operational sides: the in-gating (IG) operational side, where units are dropped off by customers and stored in parking lots to wait for subsequent loading onto outbound trains, and the inbound (IB) operational side, where units arriving via inbound trains are unloaded and stored in parking lots to wait for customer pickup. This processing of units highlights the significance of IHF resources, especially in managing the influx of both IG and IB units.

Units arriving at the IHF are assigned parking spots of parking lots within the IHF. Typically, the parking spots are assigned to the units based on capacity, such as whether parking spots are available in a parking lot, without many other considerations. In these cases, the unit is expected to be parked at the assigned parking spot. In some systems, such as the novel and improved system disclosed in pending and co-owned U.S. Patent Application with Ser. No. 18/911,387 entitled "SYSTEM AND METHOD FOR OPTIMIZING UTILIZATION OF PARKING LOT RESOURCES OF A HUB BASED ON A DUAL-STREAM RESOURCE OPTIMIZATION", the entirety of which is herein incorporated by reference for all purposes, units arriving at the IHF may be assigned parking spots in parking lot categories according to parking lot recommendations based on an optimized operating schedule. The parking lot recommendations in the optimized operating schedule are configured to optimize the assignment of the units to parking spots of parking lots of the IHF to maximize the unit throughput of the hub over a planning horizon of the optimized operating schedule.

However, despite the benefits provided by the optimized operating schedules, deviations from the parking lot recommendations are encountered more than often during execution of the optimized operating schedule. For example, IHF operators may diverge from the parking lot recommendations in the optimized operating schedule and may assign a parking spot to a unit that is different than the recommendation in the parking lot recommendation for the unit. In other cases, operators transporting the unit, due to various reasons, may not follow the parking spot assignment for the unit and may simply park the unit in an unassigned parking spot. Such divergence may stem from a multitude of factors.

Consequently, units may end up mis-parked in locations that do not align with the optimized strategy laid out in the optimized operating schedule for the IHF. This misalignment can significantly hinder the unit throughput optimization efforts, as each unit mis-parked represents a departure from the optimal flow of operations designed to maximize the unit throughput of the IHF. For example, a mis-parked unit may result in a longer drive by a hostler to pick up the unit and load it onto an outbound train. This problem is especially acute when the units are mis-parked on remote parking lots. By causing a longer hostler trip, the efficiency of the hostler resources of the IHF is negatively affected, which may lead to a reduction in the unit throughput of the IHF. As such, mis-parked units not only disrupt the smooth execution of the transportation logistics but can also lead to a cascading effect of inefficiencies, affecting the timely processing of goods and, ultimately, the service quality provided to the end customers.

SUMMARY

The present disclosure achieves technical advantages as systems, methods, and computer-readable storage media for intelligently repairing deviations in the execution of an optimized operating schedule associated with a hub. In embodiments, intelligently repairing deviations in the execution of an optimized operating schedule associated with a hub may include managing hostler-aided multi-hop operations that may be configured to repair, or rectify the impact of mis-located units within the hub by optimizing the use of hostler resources during execution of the optimized operating schedule to insert multihop operations configured to move or transport the mis-located units from suboptimal locations to optimal locations into hostler route operations, which may improve or reoptimize the unit throughput within the hub over the planning horizon of the optimized operating schedule. In embodiments, an optimal location may include a location that may lead to a higher unit throughput for the hub when the unit is parked or located therein than the unit throughput for the hub that may be obtained when the unit is located or parked at a different location (e.g., a suboptimal, less optimal, mis-located, or mis-parked location, such as a parking spot of a parking lot within the hub).

The advantageous technical result of the intelligent deviation repair functionality of embodiments includes enabling the hub optimization system to revert to a more optimal operational state, where each unit may be placed in a location (e.g., a parking spot) that maximizes the overall efficiency and unit throughput of the hub. In addition, by integrating multihop operations into hostler route operations, the system ensures that these resources are used in the most effective manner possible. Hostlers may be directed to transport units in a way that aligns with their existing routes, which leads to minimizing unnecessary travel and reducing fuel consumption and wear and tear, among other benefits.

Moreover, the functionality to intelligently repair deviations in the execution of the optimized operating schedule associated with the hub demonstrates a system's adaptability to dynamic operational conditions. This leads to an enhanced and more robust resource optimization system that may be able to adapt to unexpected conditions that may arise, and may address and correct mis-parked units, contributing to operational efficiency despite these unexpected conditions.

In embodiments, units arriving at a hub may be assigned parking spots in parking lot categories according to parking lot recommendations in an optimized operating schedule. In embodiments, the parking lot recommendations may be generated by a parking lot optimization system based on a dual-stream resource optimization (DSRO), which may include parking lot/spot assignment recommendations for units arriving during the planning horizon of the optimized operating schedule based on the expected dwell time of the units. The parking lot recommendations in the optimized operating schedule may be configured to optimize the parking spot assignment to the units to maximize the unit throughput of the hub over a planning horizon of the optimized operating schedule. In this case, a maximized or higher unit throughput may be obtained by assigning and/or parking units in optimal parking spots as recommended by the optimized operating schedule.

However, as units are mis-located or mis-parked (e.g., may be assigned and/or parked to parking spots deviating from the parking lot recommendation in the optimized operating schedule, or the operational environment on which the optimized operating schedule is based may change (e.g., trains may be delayed, hub resources may be depleted or may fail, etc.)), the optimized unit throughput provided by the optimized operating scheduled may be affected, as hostler resources may not be used in an optimized manner (e.g., hostlers may have to drive longer to the mis-parked units, etc.) leading to lower units turn over the planning horizon.

The present disclosure provides for a system integrated into a practical application with meaningful limitations as a system configured with a novel approach that includes functionality for intelligently repairing deviations in the execution of an optimized operating schedule associated with a hub by a multihop manager that includes providing functionality to leverage production hostler route operations (e.g., operations performed during production operations of the hub, such as during execution of the optimized operating schedule over the planning horizon, and that may be based on recommendations in the optimized operating schedule) to move or transport the mis-located units from the sub-optimal locations to more optimal locations. For example, in embodiments, the multihop manager may be configured to identify a unit that is mis-located (e.g., mis-located or mis-parked at a first location, such as a mis-parked location), and to determine the location (e.g., the mis-located parking spot and/or the location of the mis-located parking spot) where the unit is currently mis-located. The multihop manager may also be configured to determine an optimal location for the mis-located unit (e.g., a location, such as a parking spot, that may lead to a higher unit throughput for the hub when the mis-located unit is parked or located therein than the unit throughput for the hub that may be obtained when the mis-located unit is left at the mis-located parking spot).

In embodiments, the multihop manager may include functionality to identify one or more hostler route operations that may include a hostler route coming into proximity with the current first location (e.g., the location in which the unit is currently mis-located) of the unit and/or the optimal location. This proximity is determined based on predefined criteria, such as, for example, that the hostler route must pass within a first threshold distance of the first location and/or within a second threshold distance of the optimal location. The first and second thresholds may be configured to ensure that the redirection of the hostler to the first location and/or the optimal location does not significantly deviate from its original route and therefore does not significantly affect the utilization of the hostler resources, maintaining the efficiency of the overall system.

In embodiment, upon identifying a suitable hostler route operation that meets the above criteria (e.g., that includes a hostler route that comes into proximity with the first location in which the unit is currently mis-located and/or the optimal location), the multihop manager may execute a strategic insertion of a multihop operation into the hostler route operation. The inserted multihop operation may include one or more control signals to cause the mis-located unit to be picked up or retrieved from the first location in which the unit is currently mis-located and moved or transported to (and parked in) the optimal location. Through this sophisticated coordination, the multihop manager ensures that the mis-located unit is seamlessly integrated back into the optimal flow of operations with minimal disruption to the existing hostler logistical operations, optimizing the unit throughput of the hub and enhancing its operational efficiency, while minimizing the impact to the hostler operations.

Thus, it will be appreciated that the technological solutions provided herein, and missing from conventional systems, are more than a mere application of a manual process to a computerized environment, but rather include functionality to implement a technical process to replace or supplement current manual solutions or non-existing solutions for optimizing resources in hubs. In doing so, the present disclosure goes well beyond a mere application the manual process to a computer. Accordingly, the disclosure and/or claims herein necessarily provide a technological solution that overcomes a technological problem.

Furthermore, the functionality for intelligently repairing deviations in the execution of an optimized operating schedule associated with a hub provided by the present disclosure represents a specific and particular implementation that results in an improvement in the utilization of a computing system for resource optimization. Thus, rather than a mere improvement that comes about from using a computing system, the present disclosure, in enabling a system to leverage and optimize hostler operations to reoptimize an optimize operating schedule affected by deviations (e.g., mi-parked units), represents features that result in a computing system device that can be used more efficiently and is improved over current systems that do not implement the functionality described herein. As such, the present disclosure and/or claims are directed to patent eligible subject matter.

In various embodiments, a system may comprise one or more processors interconnected with a memory module, capable of executing machine-readable instructions. These instructions include, but are not limited to, instruction configured to implement the steps outlined in any flow diagram, system diagram, block diagram, and/or process diagram disclosed herein, as well as steps corresponding to a computer program process for implementing any functionality detailed herein, whether or not described with reference to a diagram. However, in typical implementations, implementing features of embodiments of the present disclosure in a computing system may require executing additional program instructions, which may slow down the computing system's performance. To address this problem, the present disclosure includes features that integrate parallel-processing functionality to enhance the solution described herein.

In embodiments, the parallel-processing functionality of systems of embodiments may include executing the machine-readable instructions implementing features of embodiments of the present disclosure by initiating or spawning multiple concurrent computer processes. Each computer process may be configured to execute, process or otherwise handle a designated subset or portion of the machine-readable instructions specific to the disclosure's functionalities. This division of tasks enables parallel processing, multi-processing, and/or multi-threading, allowing multiple operations to be conducted or executed concurrently rather than sequentially. By integrating this parallel-processing functionality into the solution described in the present disclosure, a system markedly increases the overall speed of executing the additional instructions required by the features described herein. This not only mitigates any potential slowdown but also enhances performance beyond traditional systems. Leveraging parallel or concurrent processing substantially reduces the time required to complete sets or subsets of program steps when compared to execution without such processing. This efficiency gain accelerates processing speed and optimizes the use of processor resources, leading to improved performance of the computing system. This enhancement in computational efficiency constitutes a significant technological improvement, as it enhances the functional capabilities of the processors and the system as a whole, representing a practical and tangible technological advancement. The integration of parallel-processing functionality into the features of the present disclosure results in an improvement in the functioning of the one or more processors and/or the computing system, and thus, represents a practical application.

In embodiments, the present disclosure includes techniques for training models (e.g., machine-learning models, artificial intelligence models, algorithmic constructs, etc.) for performing or executing a designated task or a series of tasks (e.g., one or more features of steps or tasks of processes, systems, and/or methods disclosed in the present disclosure). The disclosed techniques provide a systematic approach for the training of such models to enhance performance, accuracy, and efficiency in their respective applications. In embodiments, the techniques for training the models may include collecting a set of data from a database, conditioning the set of data to generate a set of conditioned data, and/or generating a set of training data including the collected set of data and/or the conditioned set of data. In embodiments, that model may undergo a training phase wherein the model may be exposed to the set of training data, such as through an iterative processes of learning in which the model adjusts and optimizes its parameters and algorithms to improve its performance on the designated task or series of tasks. This training phase may configure the model to develop the capability to perform its intended function with a high degree of accuracy and efficiency. In embodiments, the conditioning of the set of data may include modification, transformation, and/or the application of targeted algorithms to prepare the data for training. The conditioning step may be configured to ensure that the set of data is in an optimal state for training the model, resulting in an enhancement of the effectiveness of the model's learning process. These features and techniques not only qualify as patent-eligible features but also introduce substantial improvements to the field of computational modeling. These features are not merely theoretical but represent an integration of a concepts into a practical application that significantly enhance the functionality, reliability, and efficiency of the models developed through these processes.

In embodiments, the present disclosure includes techniques for generating a notification of an event that includes generating an alert that includes information specifying the location of a source of data associated with the event, formatting the alert into data structured according to an information format, and/or transmitting the formatted alert over a network to a device associated with a receiver based upon a destination address and a transmission schedule. In embodiments, receiving the alert enables a connection from the device associated with the receiver to the data source over the network when the device is connected to the source to retrieve the data associated with the event and causes a viewer application (e.g., a graphical user interface (GUI)) to be activated to display the data associated with the event. These features represent patent eligible features, as these features amount to significantly more than an abstract idea. These features, when considered as an ordered combination, amount to significantly more than simply organizing and comparing data. The features address the Internet-centric challenge of alerting a receiver with time sensitive information. This is addressed by transmitting the alert over a network to activate the viewer application, which enables the connection of the device of the receiver to the source over the network to retrieve the data associated with the event. These are meaningful limitations that add more than generally linking the use of an abstract idea (e.g., the general concept of organizing and comparing data) to the Internet, because they solve an Internet-centric problem with a solution that is necessarily rooted in computer technology. These features, when taken as an ordered combination, provide unconventional steps that confine the abstract idea to a particular useful application. Therefore, these features represent patent eligible subject matter.

In embodiments, one or more operations and/or functionality of components described herein can be distributed across a plurality of computing systems (e.g., personal computers (PCs), user devices, servers, processors, etc.), such as by implementing the operations over a plurality of computing systems. This distribution can be configured to facilitate the optimal load balancing of traffic (e.g., requests, responses, notifications, etc.), which can encompass a wide spectrum of network traffic or data transactions. By leveraging a distributed operational framework, a system implemented in accordance with embodiments of the present disclosure can effectively manage and mitigate potential bottlenecks, ensuring equitable processing distribution and preventing any single device from shouldering an excessive burden. This load balancing approach significantly enhances the overall responsiveness and efficiency of the network, markedly reducing the risk of system overload and ensuring continuous operational uptime. The technical advantages of this distributed load balancing can extend beyond mere efficiency improvements. It introduces a higher degree of fault tolerance within the network, where the failure of a single component does not precipitate a systemic collapse, markedly enhancing system reliability. Additionally, this distributed configuration promotes a dynamic scalability feature, enabling the system to adapt to varying levels of demand without necessitating substantial infrastructural modifications. The integration of advanced algorithmic strategies for traffic distribution and resource allocation can further refine the load balancing process, ensuring that computational resources are utilized with optimal efficiency and that data flow is maintained at an optimal pace, regardless of the volume or complexity of the requests being processed. Moreover, the practical application of these disclosed features represents a significant technical improvement over traditional centralized systems. Through the integration of the disclosed technology into existing networks, entities can achieve a superior level of service quality, with minimized latency, increased throughput, and enhanced data integrity. The distributed approach of embodiments can not only bolster the operational capacity of computing networks but can also offer a robust framework for the development of future technologies, underscoring its value as a foundational advancement in the field of network computing.

To aid in the load balancing, the computing system of embodiments of the present disclosure can spawn multiple processes and threads to process data traffic concurrently. The speed and efficiency of the computing system can be greatly improved by instantiating more than one process or thread to implement the claimed functionality. However, one skilled in the art of programming will appreciate that use of a single process or thread can also be utilized and is within the scope of the present disclosure.

It is an object of the disclosure to provide a method of intelligently repairing deviations in the execution of an optimized operating schedule associated with a hub. It is a further object of the disclosure to provide a system for intelligently repairing deviations in the execution of an optimized operating schedule associated with a hub, and a computer-based tool for intelligently repairing deviations in the execution of an optimized operating schedule associated with a hub. These and other objects are provided by the present disclosure, including at least the following embodiments.

In one particular embodiment, a method of intelligently repairing deviations in the execution of an optimized operating schedule associated with a hub is provided. The method includes determining, based on the optimized operating schedule, that a unit is mis-located within a hub at a first location and determining an optimal location for the mis-located unit. In embodiments, the optimal location results in a higher unit throughput for the hub over a planning horizon of the optimized operating schedule than the unit throughput when the mis-located unit is at the first location. The method also includes identifying one or more hostler route operations having a hostler route proximate one or more of the first location and the optimal location. In embodiments, the hostler route corresponds with one or more recommendations in the optimized operating schedule having a consolidated time-expanded network and a deconsolidated time-expanded network over the planning horizon. The method further includes inserting a multihop operation into the hostler route operation to cause the hostler to transport the mis-located unit from the first location to the optimal location, and automatically sending, during execution of the optimized operating schedule, a control signal to a controller to cause the hostler to execute the multi-hop operation.

In another embodiment, a system for intelligently repairing deviations in the execution of an optimized operating schedule associated with a hub is provided. The system comprises at least one processor and a memory operably coupled to the at least one processor and storing processor-readable code that, when executed by the at least one processor, is configured to perform operations. The operations include determining, based on the optimized operating schedule, that a unit is mis-located within a hub at a first location and determining an optimal location for the mis-located unit. In embodiments, the optimal location results in a higher unit throughput for the hub over a planning horizon of the optimized operating schedule than the unit throughput when the mis-located unit is at the first location. The operations also include identifying one or more hostler route operations having a hostler route proximate one or more of the first location and the optimal location. In embodiments, the hostler route corresponds with one or more recommendations in the optimized operating schedule having a consolidated time-expanded network and a deconsolidated time-expanded network over the planning horizon. The operations further include inserting a multihop operation into the one or more hostler route operation to cause the hostler to transport the mis-located unit from the first location to the optimal location, and automatically sending, during execution of the optimized operating schedule, a control signal to a controller to cause the hostler to execute the multi-hop operation.

In yet another embodiment, a computer-based tool for intelligently repairing deviations in the execution of an optimized operating schedule associated with a hub is provided. The computer-based tool including non-transitory computer readable media having stored thereon computer code which, when executed by a processor, causes a computing device to perform operations. The operations include determining, based on the optimized operating schedule, that a unit is mis-located within a hub at a first location and determining an optimal location for the mis-located unit. In embodiments, the optimal location results in a higher unit throughput for the hub over a planning horizon of the optimized operating schedule than the unit throughput when the mis-located unit is at the first location. The operations also include identifying one or more hostler route operations having a hostler route proximate one or more of the first location and the optimal location. In embodiments, the hostler route corresponds with one or more recommendations in the optimized operating schedule having a consolidated time-expanded network and a deconsolidated time-expanded network over the planning horizon. The operations further include inserting a multihop operation into the one or more hostler route operations to cause the hostler to transport the mis-located unit from the first location to the optimal location, and automatically sending, during execution of the optimized operating schedule, a control signal to a controller to cause the hostler to execute the multi-hop operation.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following descriptions taken in conjunction with the accompanying drawings, in which.

Figure 1:
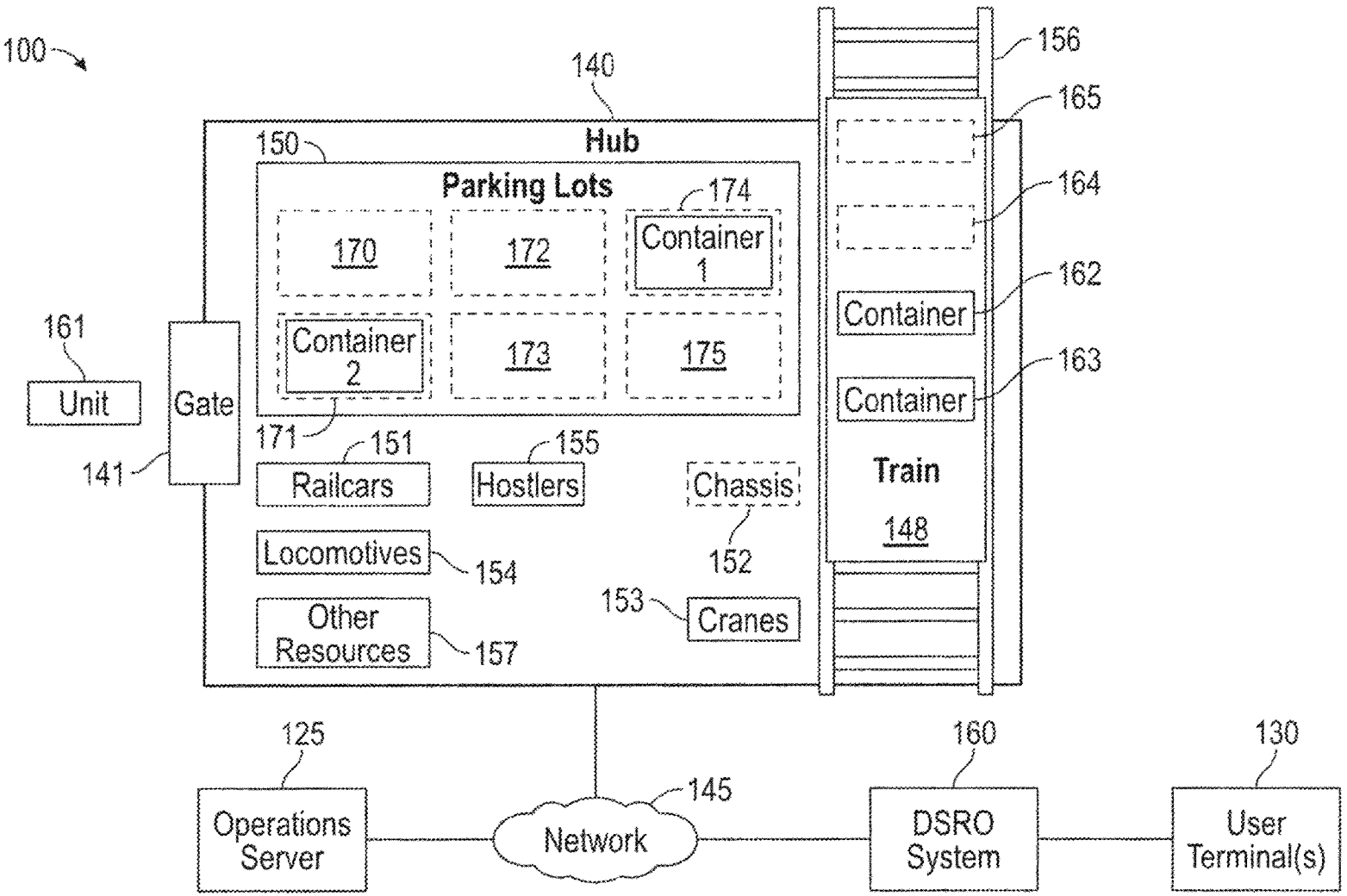
FIG. 1 is a block diagram of an exemplary system configured with capabilities and functionality for intelligently repairing deviations in the execution of an optimized operating schedule associated with a hub in accordance with embodiments of the present disclosure.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. The Examiner, after having obtained a thorough understanding of the disclosure and claims of the present application has searched the prior art as disclosed in patents and other published documents, i.e., nonpatent literature. Therefore, the issuance of this patent is evidence that: the elements and limitations presented in the claims are enabled by the specification and drawings, the issued claims are directed toward patent-eligible subject matter, and the prior art fails to disclose or teach the claims as a whole, such that the issued claims of this patent are patentable under the applicable laws and rules of this country.

Various embodiments of the present disclosure are directed to systems and techniques that provide functionality for intelligently repairing deviations in the execution of an optimized operating schedule associated with a hub. In embodiments, intelligently repairing deviations in the execution of an optimized operating schedule associated with a hub may include managing hostler-aided multi-hop operations that may be configured to repair, or rectify the impact of mis-located units within the hub by optimizing the use of hostler resources during execution of the optimized operating schedule to insert multihop operations configured to move or transport the mis-located units from suboptimal locations to optimal locations into hostler route operations, which may improve or reoptimize the unit throughput within the hub over the planning horizon of the optimized operating schedule.

In embodiments, an optimal location may include a location (e.g., a parking spot, a location in a parking lot, etc.) that may lead to a higher unit throughput for the hub when the unit is parked, placed, or located therein than the unit throughput for the hub that may be obtained when the unit is located at a different location (e.g., a suboptimal, less optimal, mis-located, or mis-parked location such as a parking spot in the same parking lot or a in a different parking lot or parking lot category). For example, a unit may be mis-located at a first location. In this example, an optimal location may include another location which, if the mis-located unit were located or parked therein, may lead to a higher unit throughput of the hub over the planning horizon of the optimized operating schedule. As such, an optimal location may be determined to be optimal with respect to an optimized operating schedule, and with respect to current operating conditions. In this manner, a location, such as a parking spot, may be optimal for a unit with respect to a first optimized operating schedule, but may not be optimal for a unit with respect to a second operating schedule. In the same manner, a location may be optimal for a unit with respect to a first set of current operating conditions, but may not be optimal for the unit with respect to a second set of current operating conditions. This is due to the fact that one of the drivers for designating a location as optimal for a unit may be whether parking or placing the unit in the location leads to a higher unit throughput within the hub over the planning horizon of the optimized operating schedule under the current set of operating conditions, when compared to parking or placing the unit in a different location.

In embodiments, a mis-located unit may include a unit that is assigned to or placed in a location (e.g., a parking spot) that diverges from the parking lot recommendations in the optimized operating schedule, or that is parked or placed in accordance with the parking lot recommendations, but, due to changed operating conditions within the hub, the location is now a suboptimal location. For example, hub operators may diverge from the parking lot recommendations in the optimized operating schedule and may assign a parking spot to a unit that is different than the recommendation in the parking lot recommendation for the unit, such as due to lack of available parking spots in the recommended parking lot. In other cases, operators transporting the unit may not follow the parking spot assignment for the unit and may simply park the unit in an unassigned parking spot (e.g., due to personal judgment or by mistake). In other cases, a parking lot recommendation to assign a parking spot in a particular parking lot category to a unit arriving at the hub during the planning horizon may be based on an expected train arrival/departure. In these cases, the unit may be assigned and parked in a parking spot according to the recommendation. However, the train arrival/departure may be delayed or accelerated, in which case the original parking lot recommendation may no longer lead to a maximized unit throughput. In this case, even though the unit was parked in accordance with the parking lot recommendation, due to the deviation in the actual train arrival/departure, leaving the unit in the assigned parking spot may lead to suboptimal unit throughput, and the unit may be considered to be misparked.

FIG. 1 is a block diagram of an exemplary system 100 configured with capabilities and functionality for intelligently repairing deviations in the execution of an optimized operating schedule associated with a hub in accordance with embodiments of the present disclosure. As shown in FIG. 1, system 100 may include user terminal 130, hub 140, network 145, operations server 125, and DSRO system 160. These components, and their individual components, may cooperatively operate to provide functionality in accordance with the discussion herein.

It is noted that the functional blocks, and components thereof, of system 100 of embodiments of the present disclosure may be implemented using processors, electronics devices, hardware devices, electronics components, logical circuits, memories, software codes, firmware codes, etc., or any combination thereof. For example, one or more functional blocks, or some portion thereof, may be implemented as discrete gate or transistor logic, discrete hardware components, or combinations thereof configured to provide logic for performing the functions described herein. Additionally, or alternatively, when implemented in software, one or more of the functional blocks, or some portion thereof, may comprise code segments operable upon a processor to provide logic for performing the functions described herein.

It is also noted that various components of system 100 are illustrated as single and separate components. However, it will be appreciated that each of the various illustrated components may be implemented as a single component (e.g., a single application, server module, etc.), may be functional components of a single component, or the functionality of these various components may be distributed over multiple devices/components. In such embodiments, the functionality of each respective component may be aggregated from the functionality of multiple modules residing in a single, or in multiple devices.

It is further noted that functionalities described with reference to each of the different functional blocks of system 100 described herein is provided for purposes of illustration, rather than by way of limitation and that functionalities described as being provided by different functional blocks may be combined into a single component or may be provided via computing resources disposed in a cloud-based environment accessible over a network, such as one of network 145.

User terminal 130 may include a mobile device, a smartphone, a tablet computing device, a personal computing device, a laptop computing device, a desktop computing device, a computer system of a vehicle, a personal digital assistant (PDA), a smart watch, another type of wired and/or wireless computing device, or any part thereof. In embodiments, user terminal 130 may provide a user interface that may be configured to provide an interface (e.g., a graphical user interface (GUI)) structured to facilitate an operator interacting with system 100, e.g., via network 145, to execute and leverage the features provided by server 110. In embodiments, the operator may be enabled, e.g., through the functionality of user terminal 130, to provide functionality for managing operations of hub 140 in accordance with embodiments of the present disclosure. For example, an operator may provide information related to train schedules, information related to units arriving at hub 140, information related to configuration of the parking lots within hub 140, information related to production track configurations, to request parking spot assignments, etc. In an additional or alternative example, the operator may receive information related to parking spot assignments for units, such as may receive parking spot assignments, may receive multihop move orders, etc. In embodiments, user terminal 130 may be configured to communicate with other components of system 100.

In embodiments, network 145 may facilitate communications between the various components of system 100 (e.g., hub 140, DSRO system 160, and/or user terminal 130). Network 145 may include a wired network, a wireless communication network, a cellular network, a cable transmission system, a Local Area Network (LAN), a Wireless LAN (WLAN), a Metropolitan Area Network (MAN), a Wide Area Network (WAN), the Internet, the Public Switched Telephone Network (PSTN), etc.

Hub 140 may represent a hub (e.g., an IHF, a train station, etc.) in which units are processed as part of the transportation of the units. In embodiments, a unit may include containers, trailers, etc., carrying goods. For example, a unit may include a chassis carrying a container, and/or may include a container. In embodiments, units may be in-gated (IG) into hub 140 (e.g., by a customer dropping the unit into hub 140). The unit, including the chassis and the container (e.g., the chassis carrying the container), may be temporarily stored in a parking space of parking lots 150, while the container awaits being assigned to an outbound train. Once assigned to an outbound train, and once the outbound train is assigned to a production track (e.g., production tracks 156), the outbound train is placed on the production track and the container is moved from the parking spot in which the container is currently stored to the production track, where the container is removed from the chassis and the container is loaded onto the outbound train for transportation to the destination of the container. On the other side of operations, a container carrying goods may arrive at the hub via an inbound (IB) train (e.g., the IB train may represent an outbound train from another hub from which the container may have been loaded), may be unloaded from the IB train and may be temporarily stored in a parking spot of parking lots 150 for eventual pickup by a customer.

Hub 140 may be described functionally by describing the operations of hub 140 as comprising two distinct flows or streams. Units (e.g., containers being carried in chassis) flowing through a first flow (e.g., an IG flow) may be received through gate 141 from various customers for eventual loading onto an appropriate outbound train. For example, customers may drop off individual units (e.g., unit 161 including a container being carried in a chassis) at hub 140. The containers arriving through the IG flow may be destined for different destinations, and may be dropped off at hub 140 at various times of the day or night. As part of the IG flow, the containers arriving at hub 140, along with the chassis in which these containers arrive, may be assigned or allocated to parking spots in one or more of parking lots 150, while these containers wait to be assigned to and loaded onto an outbound train bound to the respective destination of the containers. Once an outbound train is ready to be loaded, the outbound train (e.g., train 148) may be assigned to and placed on a production track (e.g., production track 156). At this point, the containers assigned to the outbound train may be moved from their current parking spot to the production track to be loaded onto the outbound train to be taken to their respective destination.

Units flowing through a second flow (e.g., an IB flow) may arrive at hub 140 via an IB train (e.g., train 148 may arrive at hub 140), carrying containers, such as containers 162, 163, and/or other containers, which may eventually be unloaded from the inbound train to be placed onto chassis, assigned to and parked in parking spots of parking lot 150 to be made available for delivery to (e.g., for pickup by) customers.

For example, unit 141, including a container being carried in a chassis, may be currently being dropped off into hub 140 by a customer as part of the IG flow of hub 140, and may be destined to a first destination. In this case, as part of the IG flow, unit 141 may be in-gated into hub 140 and may be assigned to a parking spot (e.g., parking spot 175) in one of parking lots 150. In this example, container 1 may have been introduced into the IG flow of hub 140 by a customer (e.g., the same customer or a different customer) previously dropping off container 1 at hub 140 to be transported to some destination (e.g., the first destination or a different destination), and may have previously been assigned to parking spot 174 of parking lots 150, where container 1 may currently be waiting to be assigned and/or loaded onto an outbound train to be transported to the destination of container 1.

As part of the IG flow, the container in unit 141 and container 1 may be assigned to an outbound train. For example, in this particular example, train 148 may represent an outbound train that is schedule to depart hub 140 to the same destination as the container in unit 141 and container 1. In this example, the container in unit 141 and container 1 may be assigned to train 148. Train 148 may be placed on one of one or more production track 156 to be loaded. In this case, as part of the IG flow, train 148 is loaded (e.g., using one or more cranes 153) with containers, including the container in unit 141 and container 1. Once loaded, train 148 may depart to its destination as part of the IG flow.

With respect to the IB flow, train 148 may arrive at hub 140 carrying several containers, including containers 2, 162, and 163. It is noted that, as part of the dual stream operations of hub 140, some resources are shared and, in this example, train 148 may arrive at hub 140 as part of the IB flow before being loaded with containers as part of the IG flow as described above. Train 148 may be placed on one of one or more production tracks 156 to be unloaded a part of the IB flow. As part of the unloading operations, the containers being carried by train 148 and destined for hub 140, may be removed from train 148 (e.g., using one or more cranes 153) and each placed or mounted on a chassis. Once on the chassis, the containers are transported (e.g., using one or more hostlers 155) to an assigned parking spot of parking lots 150 to wait to be picked up by respective customers at which point the containers and the chassis on which the containers are mounted may exit or leave hub 140. For example, container 2 may be assigned to and parked on parking spot 172.

In embodiments, processing the units through the IG flow and the IB flow may involve the use of a wide variety of resources to consolidate the units from customers into outbound trains and/or to deconsolidate inbound trains into units for delivery to customers. These resources may include hub personnel (hostler drivers, crane operators, etc.), parking spaces, chassis, hostlers, cranes, tracks, railcars, locomotives, etc. These resources may be used to facilitate holding and/or moving the units through the operations of the hub.

For example, parking lots 150 may be used to park or store units while the units are waiting to be assigned to and loaded onto outbound trains or waiting to be picked up by customers. Parking lots 150 of hub 140 may include a plurality of parking lots, each of which may include a plurality of parking spots. In the example illustrated in FIG. 1, parking lots may include parking spots 170-175. In embodiments, parking lots 150 may represent physical parking lots that may be configured with a particular layout, orientation with respect to the production tracks of hub 140, and/or distance from the production tracks. In some embodiments, the various parking lots of parking lots 150 may have different categories, based on the accessibility to the production tracks 156 from the respective parking lots. For example, some parking lots may be categorized as beachfront parking lots, high-priority hub parking lots, low-priority hub parking lots, offsite parking lots, stacked parking lots, etc. During operations, units arriving at hub 140 may be allocated to parking lot categories, in which case a unit allocated to a particular parking lot category may be assigned to a parking spot in a parking lot having the allocated particular parking lot category.

The physical parking lots may be subdivided into individual parking spots or spaces. The layout of a physical parking lot may include one or more rows of parking spots laid out around the parking lot, as well as the transit lanes within the parking lot. In this case, some of the rows of the parking lot may enjoy a higher accessibility to some production tracks than other rows. Accessibility may be measured with respect to distance from the production track or even a faster route (e.g., with less obstacles, etc.). For example, a first row of a parking lot may be closer in distance from a first production track than a second row in the same parking lot. In another example, the second row of a parking lot may be closer in distance from a second production track than the first row in the same parking lot.

Chassis 152 (e.g., including, trucks, forklifts, and/or any structure configured to securely carry a container), and operators of chassis 152, may be used to securely carry units within hub 140. Hostlers 155 (e.g., including hostler operators, etc.) may be used to transport or move the units (e.g., containers on chassis) within hub 140, such as moving units to be loaded onto an outbound train or to move units unloaded from inbound trains. Cranes 153 may be used to load units onto departing trains (e.g., to unload units from chassis 152 and load the units onto the departing trains), and/or to unload units from arriving trains (e.g., e.g., to unload units from arriving trains and load the units onto chassis 152). Railcars 151 may be used to transport the units in the train. For example, a train may be composed of one or more railcars, and the units may be loaded onto the railcars for transportation. Arriving trains may include one or more railcars including units that may be processed through the second flow, and departing trains may include one or more railcars including units that may have been processed through the first flow. Railcars 151 may be assembled together to form a train. Locomotives 154 may include engines that may be used to power a train. Other resources 157 may include other resources not explicitly mentioned herein but configured to allow or facilitate units to be processed through the first flow and/or the second flow.

In embodiments, operations server 125 may be configured to provide functionality for facilitating operations of hub 140. In embodiments, operations server 125 may include data and information related to operations of hub 140, such as current inventory of all hub resources (e.g., chassis, hostlers, drivers, lift capacity, parking lot and parking spaces, IG capacity limits, railcar, locomotives, tracks, etc.). This hub resource information included in operations server 125 may change over time as resources are consumed, replaced, and/or replenished, and operations server 125 may have functionality to update the information. Operations server 125 may include data and information related to inbound and/or outbound train schedules (e.g., arriving times, departure times, destinations, origins, capacity, available spots, inventory list of units arriving in inbound trains, etc.). In particular, inbound train schedules may provide information related to inbound trains that are scheduled to arrive at the hub during the planning horizon an optimized operating schedule (as described herein), which may include scheduled arrival time, origin of the inbound train, capacity of the inbound train, a list of units loaded onto the inbound train, a list of units in the inbound train destined for the hub (e.g., to be dropped off at the hub), etc. With respect to outbound train schedules, the outbound train schedules may provide information related to outbound trains that are scheduled to depart from the hub during the planning horizon, including scheduled departure time, capacity of the outbound train, a list of units already scheduled to be loaded onto the outbound train, destination of the outbound train, etc. In embodiment, the information from operations server 125 may be used (e.g., by DSRO system 160) to develop, generate, and/or update an optimized operating schedule based on a DSRO for managing the resources of hub 140 over a planning horizon.

In embodiments, operations server 125 may provide functionality to manage the execution of the optimized operational schedule (e.g., an optimized operating schedule generated in accordance with embodiments of the present disclosure) over the planning horizon of the optimized operating schedule. The optimized operating schedule may represent recommendations made by DSRO system 160 of how units arriving at each time increment of the planning horizon are to be processed, and how resources of hub 140 are to be managed to maximize unit throughput through the hub over the planning horizon of the optimized operating schedule. Particular to the present disclosure, the optimized operating schedule may include recommendations associated with the allocation of parking lot categories and/or parking spot assignments to units arriving at the hub at each time increment of the planning horizon. In this manner, as a unit arrives at the hub 140 at a time increment, the unit may be allocated a parking lot category and/or may be assigned a parking spot in the allocated parking lot category based on the parking lot assignment recommendations in the optimized operational schedule for the time increment. The recommendations may be based on the expected or known dwell time of the unit within hub 140, and/or the expected or known train schedules.

In embodiments, operations server 125 may manage execution of the optimized operational schedule by monitoring the consolidation stream operations flow (e.g., consolidation stream operations flow 116 of FIG. 2, which may represent the actual unit traffic flow through the IG flow during execution of the optimized operating schedule) and deconsolidation stream operations flow (e.g., deconsolidation stream operations flow 118 of FIG. 2, which may represent the actual unit traffic flow through the IB flow during execution of the optimized operating schedule) to ensure that the optimized operational schedule is being executed properly, and to update the optimized operating schedule based on the actual unit traffic, which may impact resource availability and/or consumption, especially when the actual unit traffic during execution of the optimized operational schedule differs from the predicted unit traffic used in the generation of the optimized operational schedule, and/or based on changes in the operational environment, such as changes in train arrival/departures times. In embodiments, operations server 125 may operate to provide functionality that may be leveraged during execution of the optimized operational schedule over a planning horizon to ensure that unit throughput through the hub is maximized over the planning horizon.

DSRO system 160 may be configured to manage resources of hub 140 based on a DSRO to maximize unit throughput within hub 140 in accordance with embodiments of the present disclosure. For example, DSRO system 160 may be configured to generate an optimized operating schedule that may represent recommendations by DSRO system 160 of how units arriving at each time increment of the planning horizon are to be processed, and/or how resources of hub 140 are to be managed to maximize unit throughput of the hub over the planning horizon of the optimized operating schedule. In particular, DSRO system 160 may be configured to provide the main functionality of system 100 to intelligently repair deviations in an execution of an optimized operating schedule associated with the hub. For example, in embodiments, DSRO system 160 may implement the intelligent deviation repair functionality by leveraging the functionality of a multihop operations manager (e.g., multihop operations manager 126 of FIG. 2).

Figure 2:
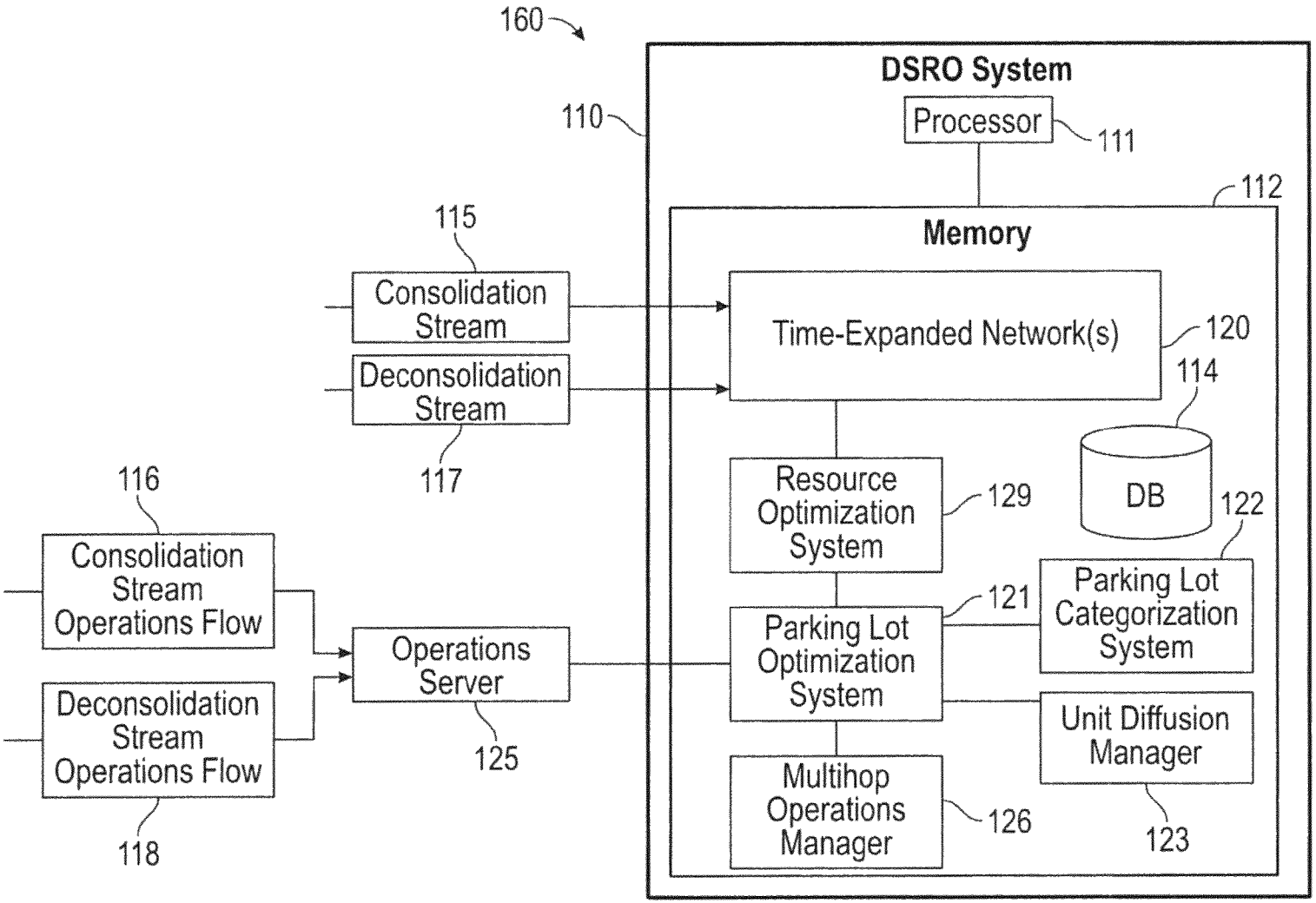
FIG. 2 is a block diagram illustrating an example of dual-stream resource optimization (DSRO) system configured with capabilities and functionality for intelligently repairing deviations in the execution of an optimized operating schedule associated with a hub in accordance with embodiments of the present disclosure.

FIG. 2 is a block diagram illustrating an example of DSRO system 160 configured with capabilities and functionality for intelligently repairing deviations in the execution of an optimized operating schedule associated with a hub in accordance with embodiments of the present disclosure. As shown in FIG. 2, DSRO system 160 may be implemented in a server (e.g., server 110). In embodiments, functionality of server 110 to facilitate operations of DSRO system 160 may be provided by the cooperative operation of the various components of server 110, as will be described in more detail below.

It is noted that although FIG. 2 shows server 110 as a single server, it will be appreciated that server 110 (and the individual functional blocks of server 110) may be implemented as separate devices and/or may be distributed over multiple devices having their own processing resources, whose aggregate functionality may be configured to perform operations in accordance with the present disclosure. Furthermore, those of skill in the art would recognize that although FIG. 2 illustrates components of server 110 as single and separate blocks, each of the various components of server 110 may be a single component (e.g., a single application, server module, etc.), may be functional components of a same component, or the functionality may be distributed over multiple devices/components. In such embodiments, the functionality of each respective component may be aggregated from the functionality of multiple modules residing in a single, or in multiple devices. In addition, particular functionality described for a particular component of server 110 may actually be part of a different component of server 110, and as such, the description of the particular functionality described for the particular component of server 110 is for illustrative purposes and not limiting in any way.

As shown in FIG. 2, server 110 includes processor 111, memory 112, time-expanded network 120, parking lot optimization system 121, multihop operations manager 126, resources optimization system 129, and database 114.

Processor 111 may comprise a processor, a microprocessor, a controller, a microcontroller, a plurality of microprocessors, an application-specific integrated circuit (ASIC), an application-specific standard product (ASSP), or any combination thereof, and may be configured to execute instructions to perform operations in accordance with the disclosure herein. In some embodiments, implementations of processor 111 may comprise code segments (e.g., software, firmware, and/or hardware logic) executable in hardware, such as a processor, to perform the tasks and functions described herein. In yet other embodiments, processor 111 may be implemented as a combination of hardware and software. Processor 111 may be communicatively coupled to memory 112.

Memory 112 may comprise one or more semiconductor memory devices, read only memory (ROM) devices, random access memory (RAM) devices, one or more hard disk drives (HDDs), flash memory devices, solid state drives (SSDs), erasable ROM (EROM), compact disk ROM (CD-ROM), optical disks, other devices configured to store data in a persistent or non-persistent state, network memory, cloud memory, local memory, or a combination of different memory devices. Memory 112 may comprise a processor readable medium configured to store one or more instruction sets (e.g., software, firmware, etc.) which, when executed by a processor (e.g., one or more processors of processor 111), perform tasks and functions as described herein.

Memory 112 may also be configured to facilitate storage operations. For example, memory 112 may comprise database 114 for storing various information related to operations of system 100. For example, database 114 may store configuration information related to operations of DSRO system 160. In embodiments, database 114 may store information related to various models used during operations of DSRO system 160, such as a DSRO model, a parking lot optimization model, a parking lot classification model, an ingate prediction model, an inbound prediction model, a unit diffusion model, a hostler route operations model, a multihop operations model, etc. Database 114 is illustrated as integrated into memory 112, but in some embodiments, database 114 may be provided as a separate storage module or may be provided as a cloud-based storage module. Additionally, or alternatively, database 114 may be a single database, or may be a distributed database implemented over a plurality of database modules.

As mentioned above, operations of hub 140 may be represented as two distinct flows, an IG flow in which units arriving to hub 140 from customers are consolidated into outbound trains to be transported to their respective destinations, and an IB flow in which inbound trains arriving to hub 140 carrying units are deconsolidated into the units that are stored in parking lots while waiting to be picked up by respective customers. DSRO system 160 may be configured to represent the IG flow as consolidation stream 115 including a plurality of stages. Each stage of consolidation stream 115 may represent different operations or events that may be performed or occur to facilitate the IG flow of hub 140. DSRO system 160 may be configured to represent the IB flow as deconsolidation stream 117 including a plurality of stages. Each stage of deconsolidation stream 117 may represent different operations or events that may be performed or occur to facilitate the IB flow of hub 140.

In embodiments, the interaction between consolidation stream 115 and deconsolidation stream 117, may represent the consumption of resources during the execution of the optimized operating schedule. For example, the assignment of parking spots of parking lots 150, and the allocation of parking lot categories during execution of the optimized operating schedule may be based on the predicted interaction between consolidation stream 115 and deconsolidation stream 117 during execution, which may provide significant insight into the parking lot resource consumption based on the expected unit traffic and/or parking lot resource capacity during the planning horizon of the optimized operating schedule. In this manner, the parking lot recommendations generated by DSRO system 160 are based on the interaction between consolidation stream 115 and deconsolidation stream 117.

In another example, the utilization of chassis and hostler resources within hub 140 between consolidation stream 115 and deconsolidation stream 117, which may be collaborative, may also be based on the interaction between consolidation stream 115 and deconsolidation stream 117. In this manner, hostler operations (e.g., hostler route operations in which a hostler is assigned to follow a route to pick up a unit from a parking spot and ramp the unit onto an outbound train and/or to deramp a unit from an incoming train and transport it to an assigned parking spot) may be based on the optimized operating schedule.

In embodiments, DSRO system 160 may be configured to optimize the use of resources to maximize the throughput of the hub (e.g., the rate of units processed through the hub) by generating one or more time-expanded networks 120 to represent consolidation stream 115 and deconsolidation stream 117, and configuring the DSRO model to use one or more time-expanded networks 120, over a planning horizon, to optimize the use of the resources of the hub that support the unit flow within the planning horizon to maximize the throughput of units over the planning horizon. In embodiments, the DSRO model may generate, based on the one or more time-expanded networks 120, an optimized operating schedule that includes one or more of a determined unit flow through one or more of the stages of time-expanded network (e.g., the consolidation and/or deconsolidation stream time-expanded networks) at each time increment of the planning horizon, an indication of a resource deficit or overage at one or more of the stages of each time-expanded network at each time increment of the planning horizon, and/or an indication or recommendation of a resource replenishment to be performed at one or more of the stages of each time-expanded network at each time increment of the planning horizon to ensure the optimized operating schedule is met.

Particular to the present disclosure, the optimized operating schedule may include recommendations for allocating units of particular types (e.g., particular dwell time type) to parking lots categories through each of the consolidation stream 115 and/or deconsolidation stream 117 at each time increment of the planning horizon, based on predictions and/or expectations of the optimized operating schedule (e.g., predicted or expected dwell time of the units, predicted and/or expected unit traffic, resource consumption, resource availability, resource capacity, environmental factors, etc.). In this manner, during operations, such as during execution of the optimized operating schedule, units are assigned to locations (e.g., parking spots) within parking lot categories in accordance with the recommendations in the optimized operating schedule, which represent locations that are calculated or predicted to result in a maximized unit throughput of the hub over the planning horizon of the optimized operating schedule.

In embodiments, DSRO system 160 may be configured to apply the generated DSRO model to the time-expanded networks 120 to optimize the use of the resources (e.g., parking lot resources) by the consolidation and deconsolidation streams over the planning horizon to maximize throughput of the hub over the planning horizon. To that end, DSRO 160 may include a plurality of optimization systems. For example, resource optimization system 129 may be configured to generate, based on the DSRO model, an optimized operating schedule that may be implemented over a planning horizon to maximize throughput of units through the hub. In particular, resource optimization manager 129 may be configured to consider resource availability (e.g., resource inventory), resource replenishment cycles, resource cost, operational implications of inadequate supply of resources, for all the resources involved in the consolidation and deconsolidation streams to determine the optimized operating schedule that may maximize throughput through the hub over the planning horizon. Resource optimization manager 129 may be configured to additionally consider unit volumes (e.g., unit volumes expected to flow during the planning horizon through the consolidation stream and the deconsolidation streams, such as at each time increment of the planning horizon) and unit dwell times (e.g., expected dwell times of units flowing through the consolidation stream and the deconsolidation streams during the planning horizon) to determine the optimized operating schedule that may maximize throughput through the hub over the planning horizon.

During operations (e.g., during execution of the operating schedule, when units arrive at the hub), operations server 125 may operate to manage execution of the optimized operational schedule by monitoring consolidation stream operations flow 116 (e.g., the actual traffic flow through the consolidation stream 115 during execution of the optimized operating schedule) and deconsolidation stream operations flow 118 (e.g., the actual traffic flow through the deconsolidation stream 117 during execution of the optimized operating schedule) to ensure that the optimized operational schedule is being executed properly, and to update the optimized operating schedule based on the actual unit traffic, which may impact resource availability and/or consumption, especially when the actual unit traffic during execution of the optimized operational schedule differs from the predicted unit traffic used in the generation of the optimized operational schedule.

In embodiments, the functionality of DSRO system 160 to optimize the utilization of parking lots 150 of hub 140 may include leveraging the functionality of parking lot optimization system 121 to define, refine, or otherwise determine parking lot allocation operations in an optimized manner, which may facilitate implementation of the optimized operating schedule. For example, in embodiments, parking lot optimization system 121 may be configured to generate parking lot allocation recommendations for the optimized operating schedule such that, for each time increment of the planning horizon, parking lot categories are allocated to units expected to arrive during each of the time increment based on the expected dwell time of the arriving units and/or based on the parking lot categories. For example, for a first time increment within the planning horizon, an optimized operating schedule may expect a number of short-dwelling units and a number of long-dwelling units, and may recommend parking lot categories to allocate to units arriving during the first time increment based on the unit's predicted or expected dwelling time. For example, parking lot optimization system 121 may allocate, for the first time increment, a parking lot category (e.g., a high-priority parking lot) to the short-dwelling units and a parking lot category (e.g., a lower-priority parking lot) to the long-dwelling units, based on the parking lot capacity and/or expected available parking spaces. During execution, operations server 125 may assign parking spots within parking lot categories recommended in the parking lot recommendations to unit arriving during the planning horizon of the optimized operating schedule. For example, following the example, above, operations server 125 may assign a parking spot within the allocated parking lot category recommended in the parking lot recommendations to a unit arriving during the first time increment, where the parking lot category recommendation is based on the dwell time of the unit. In this manner, parking lot optimization system 121 may be configured to maximize the throughput of the parking lot spaces of hub 140 by ensuring that short-dwelling units are assigned to parking spaces that are easily accessible, that medium-dwelling units to are assigned to parking spaces that are somewhat less accessible than the easily accessible parking spaces, and so on. In embodiments, parking lot optimization system 121 may consider the interaction between the consolidation stream time-expanded network and the deconsolidation stream time-expanded network, and the unit volume and dwell time composition of each stream while allocating the units to parking lots optimally.

In embodiments, parking lot optimization system 121 may cooperatively operate with parking lot categorization system 122, which may be configured to classify or categorize parking lots of parking lots 150 into different categories, depending, in some embodiments, on their proximity or accessibility to production tracks, their proximity or accessibility to hostler storage, their proximity or accessibility to the ingate (e.g., for customer pickup), etc. In this manner, the category of a parking lot, which may be based on the accessibility of the parking lot, may be useful when determining how accessible a unit stored in the parking lot is to be moved, which may impact the throughput of the parking lots. The parking lot categories may be used by the parking lot optimization system 121 to allocate parking lots to expected units at each time increment of the planning horizon of the optimized operating schedule.

In embodiments, unit diffusion manager 123 may be configured to further refine or optimize the parking lot allocation recommendations generated by parking lot optimization system 121 by applying an intelligent diffusion algorithm, process, or model to the parking lot allocation recommendations to intelligently spread or diffuse the units allocated to the parking lot categories across parking spots of the parking lot categories allocated to the units to minimize the transport time of the units from their respective parking spot to their respectively assigned outbound transport (e.g., respectively assigned outbound train (in the case of IG units) and/or respectively associated customer transport (e.g., in the case of IB units being picked up by customers)).

In embodiments, multihop operations manager 126 may be configured to intelligently repair deviations in the execution of the optimized operating schedule. For example, as noted above, operations server 125 may manage the execution of the optimized operational schedule over the planning horizon of the optimized operating schedule. Managing the execution of the optimized operating schedule may include allocating, to units arriving at the hub during the planning horizon, parking lot categories (e.g., assigning parking spots within allocated parking lot categories) within the hub based on parking lot recommendations in the optimized operating schedule. In this manner, as a unit arrives at the hub 140 at a time increment, the unit may be allocated a parking lot category and/or may be assigned a parking spot in the allocated parking lot category based on the parking lot recommendations in the optimized operational schedule for the time increment. For example, during execution of the optimized operational schedule, an operator may request and/or receive (e.g., via user terminal 130) a parking spot assignment for a unit from operations server 125, in which case operations server 125 may assign a parking spot in a parking lot, or may assign a parking spot in a parking lot category, to the unit, based on the parking lot recommendations in the optimized operational schedule. The operator may receive the parking spot assignment and may then transport and park (or may cause to transport and park) the unit in the assigned parking spot in accordance with the optimized operating schedule. It is noted that, in this case, the assigned parking spot may represent an optimal location that is configured to maximize the unit throughput of the hub over a planning horizon of the optimized operating schedule. In this case, a maximized or higher unit throughput may be obtained by assigning and/or parking the unit to and/or in the optimal parking spot as recommended by the optimized operating schedule.

However, in some cases, the unit may be mis-located. For example, in some cases, the parking lot assignment recommendations in the optimized operational schedule may call for an assignment of a parking spot in a particular parking lot category for a unit of a particular type (e.g., having a particular dwell time) arriving at a time increment of the planning horizon of the optimized operating schedule. However, the particular parking lot category may be full and may have no capacity (e.g., no available or free parking spots) when the unit arrives at the time increment of the planning horizon. This may be for a number of reasons (e.g., actual unit traffic may be different than the predicted traffic in the optimized operating schedule), but in this case, operations server 125 may deviate from the parking lot assignment recommendation in the optimized operational schedule and may instead assign a parking spot to the unit that is in a different parking lot category than the parking lot category called for in the parking lot assignment recommendation (e.g., may assign a mis-located parking spot to the unit). In this case, the unit may be placed or parked in the mis-located parking spot in accordance with the assignment. The mis-located parking spot may represent a parking spot that is suboptimal with respect to unit throughput, as it may be a parking spot that does not result in a maximized unit throughput over the planning horizon of the optimized operating schedule when the unit is parked therein. On the other hand, the original parking lot category recommendation may include a parking spot that may result in a higher unit throughput when the unit is parked therein than the unit throughput resulting from parking the unit in the mis-located parking spot (e.g., the parking spot in the original parking lot category may be an optimal parking spot).

In another example, the unit may be mis-located because, even though operations terminal 125 may assign a parking spot in a parking lot category that is consistent with the parking lot assignment recommendations in the optimized operational schedule (e.g., that does not deviate from the parking lot category in the parking lot recommendations), the operator transporting the unit to the assigned parking spot may not follow the parking spot assignment. This could be because the operator may make a mistake and park the unit in a different parking spot, or may be simply because the operator may decide, based on their judgment, to park the unit in a different parking spot. The result, however, is that the unit may be mis-located in a parking spot that is not the assigned parking spot, which may negatively affect the unit throughput of the hub. In this case, as the mis-located parking spot is not the one assigned based on the parking lot assignment recommendations in the optimized operational schedule, the mis-located parking spot may represent a suboptimal parking spot.

In still another example, the unit may be mis-located because, even though operations terminal 125 may assign a parking spot in a parking lot category that is consistent with the parking lot assignment recommendations in the optimized operational schedule (e.g., that does not deviate from the parking lot category in the parking lot recommendations) and the operator transporting the unit to the assigned parking spot may follow the parking spot assignment (e.g., may park the unit in the assigned parking spot), the assigned parking spot may no longer be an optimal parking spot due to changes in the operational environment of the hub. For example, due to changes in the operational environment of the hub during the planning horizon of the optimized operating schedule, the assigned parking spot may no longer result in a maximized unit throughput in the hub over the planning horizon. The changes in the operational environment of the hub may include delays or advances in the arrival and/or departure times of the trains scheduled to transit through the hub, differences in the actual unit traffic from the predicted or expected unit traffic in the optimized operating schedule, differences in the actual resource consumption/capacity from the predicted or expected resource consumption/capacity in the optimized operating schedule. In this case, as the parking lot assignment recommendations in the optimized operational schedule may be based on expected operational environment over the planning horizon, the changes in the operational environment during execution of the optimized operating schedule may render the parking lot recommendations suboptimal or less than optimal with respect to unit throughput in the hub over the planning horizon. In this case, even though the assigned parking spot in the allocated parking lot category may have been an optimal parking spot assignment (e.g., a parking spot assignment resulting in an optimized or maximized unit throughput over the planning horizon) at the time of the assignment, due to the changes in the operational environment of the hub, the parking spot assignment may no longer be an optimal parking spot assignment. This change in the operational environment of the hub may occur before, during, or after the parking spot assignment.

In embodiments, the mis-location of the unit may represent a deviation in the execution of the optimized operating schedule multihop operations manager 126 may be configured to intelligently repair deviations in the execution of the optimized operating schedule by implementing a DSRO based approach that includes managing hostler-aided multihop operations that may be configured to repair, or rectify the impact of mis-located units within the hub by optimizing the use of hostler resources during execution of the optimized operating schedule. Managing the hostler-aided multihop operations may include leveraging production hostler route operations (e.g., hostler rout operations performed during production operations of the hub, such as during execution of the optimized operating schedule over the planning horizon, and that may be based on recommendations in the optimized operating schedule) to move or transport the mis-located units from the suboptimal locations to more optimal locations.

In embodiments, multihop operations manager 126 may be configured to identify a unit that is mis-located (e.g., mis-located or mis-parked at a first location, such as a mis-located parking spot) and/or to determine the first location (e.g., the mis-located parking spot and/or the location of the mis-located parking spot) where the unit is currently mis-located. In some embodiments, multihop operations manager 126 may determine that a unit is mis-located at the first location by calculating the unit throughput of the hub over the planning horizon based on the unit being parked or located in the first location (e.g., the parking spot and/or parking lot category in which the unit is currently mis-located) and determining that the calculated unit throughput of the hub based on the unit being located or parked in the first location is not maximized and/or is less than the unit throughput predicted or expected from the optimized operating schedule.

In embodiments, multihop operations manager 126 may be configured to determine that a unit is mis-located at the first location by evaluating whether the first location in which the unit is currently located is inconsistent with the parking lot recommendations in the optimized operating schedule for the unit type or not. This determination may involve a comparison between the current location of the unit and the recommended location assignment in the optimized operating schedule, which is configured to maximize operational efficiency and throughput. For example, multihop operations manager 126 may determine that the parking lot category in which the first location is located is not consistent with the recommended parking lot category in the optimized operating schedule for the dwell time of the unit at the time increment in which the unit arrived. Such a mis-location may lead to inefficiencies, such as prolonged retrieval times or congestion for a hostler retrieving the unit from the current location, adversely affecting the overall throughput and operational efficiency of the hub.

In embodiments, multihop operations manager 126 may determine that a unit is mis-located at the first location by determining that the operational environment of the hub has changed, and that the operational environment change results in the expected or predicted unit throughput of the hub over the planning horizon being negatively affected (e.g., reduced, non-optimized, not maximized) due to the unit being located or parked in the first location. In this case, multihop operations manager 126 may determine that the changes in the operational environment of the hub have rendered the first location (e.g., the parking spot and/or parking lot category in which the unit is currently mis-located) suboptimal or less than optimal with respect to unit throughput in the hub over the planning horizon. In this case, even though the first location may have been an optimal location at the time the unit was assigned to the first location, due to the changes in the operational environment of the hub, the first location is no longer be an optimal location. Based on this, multihop operations manager 126 may determine that the unit is mis-located at the first location.

In embodiments, multihop operations manager 126 may be configured to determine an optimal location for the mis-located unit. Multihop operations manager 126 may determine an optimal location by determining a location (e.g., a parking spot) that may lead to a higher unit throughput for the hub when the mis-located unit is parked or located therein than the unit throughput for the hub that may be obtained when the mis-located unit is left at the first location (e.g., the mis-located parking spot). The optimal location may be obtained from the optimized operating schedule, such as determining a location that is consistent with the optimized operating schedule. For example, multihop operations manager 126 may determine that the parking lot recommendations for the unit (e.g., a parking lot recommendation for a unit arriving at a particular time increment of the planning horizon of the dwell type of the unit) recommends a second location, such as another parking spot or a parking spot in another parking lot category (e.g., different than the parking spot and/or parking lot category in which the unit is currently mis-located).

In additional or alternative embodiments, multihop operations manager 126 may determine the optimal location by calculating the unit throughput of the hub over the planning horizon based on the unit being parked or located in the parking spot and/or parking lot category in which the unit is currently mis-located, calculating the unit throughput of the hub over the planning horizon based on the unit being parked in each of one or more other parking spots (e.g., in the same parking lot category in which the unit is currently mis-located, and/or in a different parking lot category than the parking lot category in which the unit is currently mis-located), and determining one or more parking spots that yield a higher unit throughput over the planning horizon when the unit is parked therein.

In embodiments, multihop operations manager 126 may be configured to determine that the optimal location is currently available, or is to be available in an upcoming time increment of the planning horizon. For example, multihop operations manager 126 may monitor (e.g., continuously or at intervals) the status of locations (e.g., parking spots) within the hub, applying algorithms that predict when each location may be vacated within the planning horizon based on a variety of factors, including the anticipated dwell times of currently parked units, scheduled arrivals and departures, and historical data patterns. This predictive capability allows multihop operations manager 126 to identify when a location identified as an optimal location for unit is, becomes, or is to become available. In some embodiments, multihop operations manager 126 may issue a control signal to reserve an optimal location for the unit. In embodiments, multihop operations manager 126 may be configured to adjust its predictions and allocations in response to changes within the operational environment, such as unexpected delays, early departures, or sudden increases in unit arrivals. By dynamically updating the assessments of location availability and adjusting the planning horizon accordingly, multihop operations manager 126 may ensure that the operational layout remains fluid and responsive to real-time conditions, which may enhance the overall throughput of the operation by determining the current and impending availability of optimal locations within the planning horizon, playing a crucial role in maintaining a high level of operational efficiency, adaptability, and foresight.

In embodiments, multihop operations manager 126 may be configured to identify one or more candidate hostler route operations for attaching a multihop operation configured to move the unit from the first location (e.g., the current location in which the unit is mis-located) to the optimal location while minimizing the impact to the optimized hostler operations. The one or more candidate hostler route operations may be identified by determining hostler route operations that may meet particular criteria. The hostler route operations may represent hostler operations performed during production operations of the hub, such as during execution of the optimized operating schedule over the planning horizon. These hostler route operations may include operations in which a hostler may be assigned to follow a route to pick up a unit from a parking spot and transport the unit to production tracks to ramp the unit onto an outbound train and/or to deramp a unit from an inbound train and transport the unit to a parking spot assigned to the unit. These hostler route operations may be based on recommendations in the optimized operating schedule, defining how units parked in parking spaces in the hub may be moved or transported to load them or ramp them onto outbound trains and/or how units arriving in inbound trains may be deramped or unloaded from the inbound trains and moved or transported to their assigned parking spots. These particular recommendations related to hostler operations in the optimized operating schedule may be configured to optimize the use of the hostler resources over the planning horizon.

In embodiments, multihop operations manager 126 may be configured to identify the one or more candidate route operations by determining hostler route operations having a hostler route that comes into proximity with the first location (e.g., the location in which the unit is currently mis-located) and/or the optimal location. A hostler route of a hostler route operation may include the route that is traveled by the hostler to perform the hostler route operation. The hostler route may include the route from the current location of the hostler to a location of the unit to be picked up to the location where the unit is to be dropped off. For example, a ramping hostler route operation may include picking up a unit from a parking spot and ramping the unit onto an outbound train. In this example, the hostler route of this ramping hostler route operation may include the route traveled by the hostler to the pickup location (e.g., could include the current location of the hostler which could be hostler parking or another location within the hub) and then from the pickup location to the train car on which the unit is to be loaded onto the outbound train. In another example, a deramping hostler route operation may include deramping a unit from an inbound train and dropping the unit off in an assigned parking spot. In this example, the hostler route of this deramping hostler route operation may include the route traveled by the hostler to the location of the train car carrying the unit to the assigned parking spot in which the unit is to be parked.

In embodiments, determining whether a hostler route of a hostler route operation comes into proximity with the first location and/or the optimal location may include determining whether the hostler route includes the hostler passing within a first threshold distance of the first location and/or within a second threshold distance of the optimal location. In embodiments, the first and second thresholds may be configured (e.g., by an operator or automatically by the system) to ensure that redirecting the hostler to the first location and/or the optimal location does not significantly impact the hostler route (e.g., does not add a significant driving distance and/or time to the hostler route), and therefore does not significantly affect the utilization of the hostler resources. In embodiments, the first and second thresholds may be configured as numbers of parking spots. For example, the first threshold may include 1-50 parking spots from the first location, and the second threshold may include 1-50 parking spots from the optimal location.

For example, multihop operations manager 126 may be configured to identify one or more candidate hostler route operations by determining hostler route operations that come within the first threshold distance of the first location and/or within the second threshold distance of the optimal location. For example, following the example above, multihop operations manager 126 may identify one or more ramping hostler route operations (e.g., one or more hostler route operations that involves picking up a unit from a parking spot and ramping the unit onto an outbound train) having a route that brings the hostler within the first threshold of the first location and/or within the second threshold of the optimal location, and/or may identify one or more deramping hostler route operations (e.g., one or more hostler route operations that involves deramping a unit from an inbound train and dropping the unit off in an assigned parking spot) having a route that brings the hostler within the first threshold of the first location and/or within the second threshold of the optimal location. In this manner, multihop operations manager 126 may identify hostler route operations that may be suitable to support a multihop operation to move the mis-located unit from the first location to the optimal location while minimizing the impact to the hostler route operations.

In embodiments, multihop operations manager 126 may link two hostler route operations based on their associated hostler routes and may include the linked hostler route operations in the one or more candidate hostler route operations. Multihop operations manager 126 may determine to link the two hostler route operations to further minimize the impact to the hostler route operations caused by the attachment or insertion of the multihop operation into the one or more candidate hostler route operations. For example, a deramping hostler route operation of a hostler (e.g., a hostler route operation that involves deramping a unit from an inbound train and dropping the unit off in an assigned parking spot) may have a route that includes a drop off point (e.g., the location of the assigned parking spot in which the unit is to be dropped off) that comes into proximity with the first location (e.g., the current location in which the unit is mis-located). In the same example, a ramping hostler route operation of the same hostler (e.g., a hostler route operation that involves picking up a unit from a parking spot and ramping the unit onto an outbound train) may have a route that includes a pickup point (e.g., the location of the parking spot in which the unit is currently mis-located) that comes into proximity with the optimal location. In this case, multihop operations manager 126 may link these two hostler route operations together determining that inserting a multihop operation to move the unit from the first location to the optimal location may be performed by the hostler with minimal impact to the hostler route operations. This is because multihop operations manager 126 may determine that during the deramping hostler route operation, the hostler comes within the first threshold distance of the current location of the mis-located unit (e.g., the first location) and the hostler may pick up the mis-located unit, after dropping off the deramped unit, with minimal impact as the hostler does not have to drive long to get to the first location. In the same manner, multihop operations manager 126 may determine that the ramping hostler route operation requires that the hostler pick up the ramped unit from the pickup location, which is within the second threshold distance from the optimal location, and in this manner, the hostler may travel, with the mis-located unit in tow, from the first location to the optimal location, which represents an efficient use of the hostler route resulting in a minimal impact to transport the mis-located unit from the first location to the optimal location.

In embodiments, multihop operations manager 126 may be configured to generate a multihop operation configured to move the mis-located unit from the first location to the optimal location while minimizing the impact to the one or more candidate hostler route operations. In embodiments, the multihop operation may include one or more moves that may bring the mis-located unit from the first location to the optimal location determined by multihop operations manager 126. The one or more moves may include a single move that transports the unit from the first location to the optimal location, or may include multiple moves, each of the multiple moves configured to move the unit successively closer to the optimal location until the unit is moved to the optimal location. In this case, the optimal location may include multiple locations, where each of the multiple locations is successively closer to the optimal location.

In embodiments, multihop operations manager 126 may be configured to insert the multihop operation into the one or more candidate hostler route operations. In embodiments, multihop operations manager 126 may insert, append, and/or prepend the multihop operation to one or more of the hostler route operations of the one or more candidate hostler route operations. In embodiments, inserting the multihop operation into the one or more candidate hostler route operations may include generating one or more control signals to cause the mis-located unit to be picked up or retrieved from the first location in which the unit is currently mis-located and moved or transported to (and parked in) the optimal location. In embodiments, the control signal may include a control signal automatically transmitted to controller that may automatically activate a hostler to pick up the mis-located unit from the first location in which the unit is currently mis-located and move it to the optimal location. In some embodiments, the control signal may include a signal to insert a work order configured to cause the hostler performing the hostler route operations in the one or more candidate hostler route operations to pick up the mis-located unit from the first location in which the unit is currently mis-located and move it to the optimal location.

In embodiments, the control signal may define the sequence and/or point at which the mis-located unit is picked up from the first location and dropped off at the optimal location. For example, in some embodiments, the signal may prepend the multihop operation to a ramping hostler route operation, in which case the control signal may cause the hostler to pick up the mis-located unit from the first location and move it to the optimal location, and then perform the ramping operation (e.g., and then drive to the location of the ramped unit, pick up the ramped unit, drive the ramped unit to the outbound train, and load the ramped unit ono the outbound train). In another example, the signal may append the multihop operation to a deramping hostler route operation, in which case the control signal may cause the hostler to perform the deramping operation (e.g., deramp the deramped unit from the inbound train, drive the deramped unit to the assigned parking spot, and parked the deramped unit in the assigned parking spot) and then drive to the first location to pick up the mis-located unit from the first location and move it to the optimal location. In some embodiments, such as when the multihop operation is inserted into linked hostler route operations (e.g., linked ramping hostler route operation and deramping hostler route operation), the signal may prepend the multihop operation to the ramping hostler route operation and/or may append the multihop operation to the deramping hostler route operation. In this example, the multihop operation may be sandwiched between the deramping hostler route operation and the ramping hostler route operation.

Figure 3:
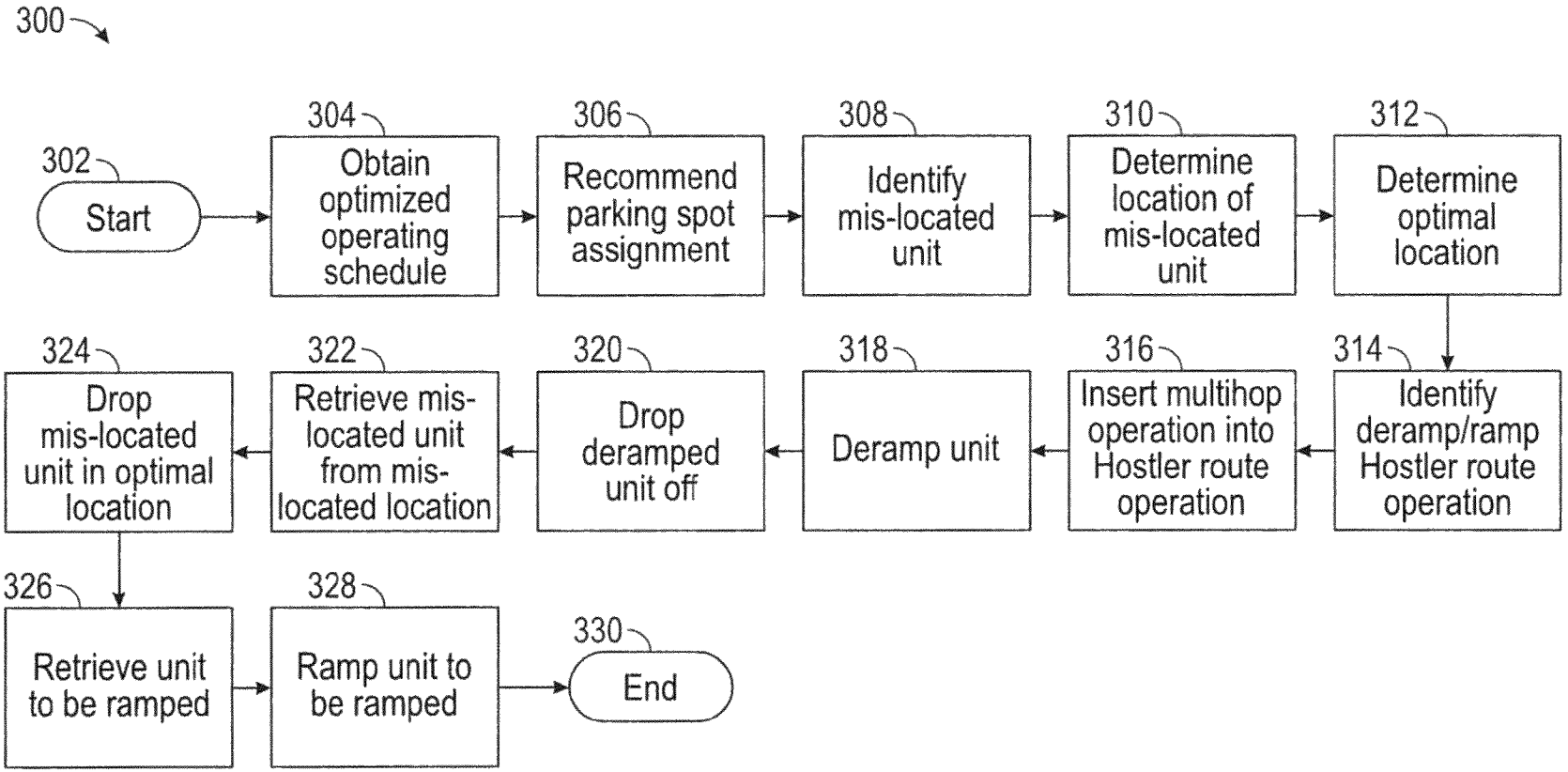
FIG. 3 is a flowchart illustrating operations of a multihop operations manager to intelligently repair deviations in the execution of an optimized operating schedule associated with a hub in accordance with embodiments of the present disclosure.
Figure 4A:
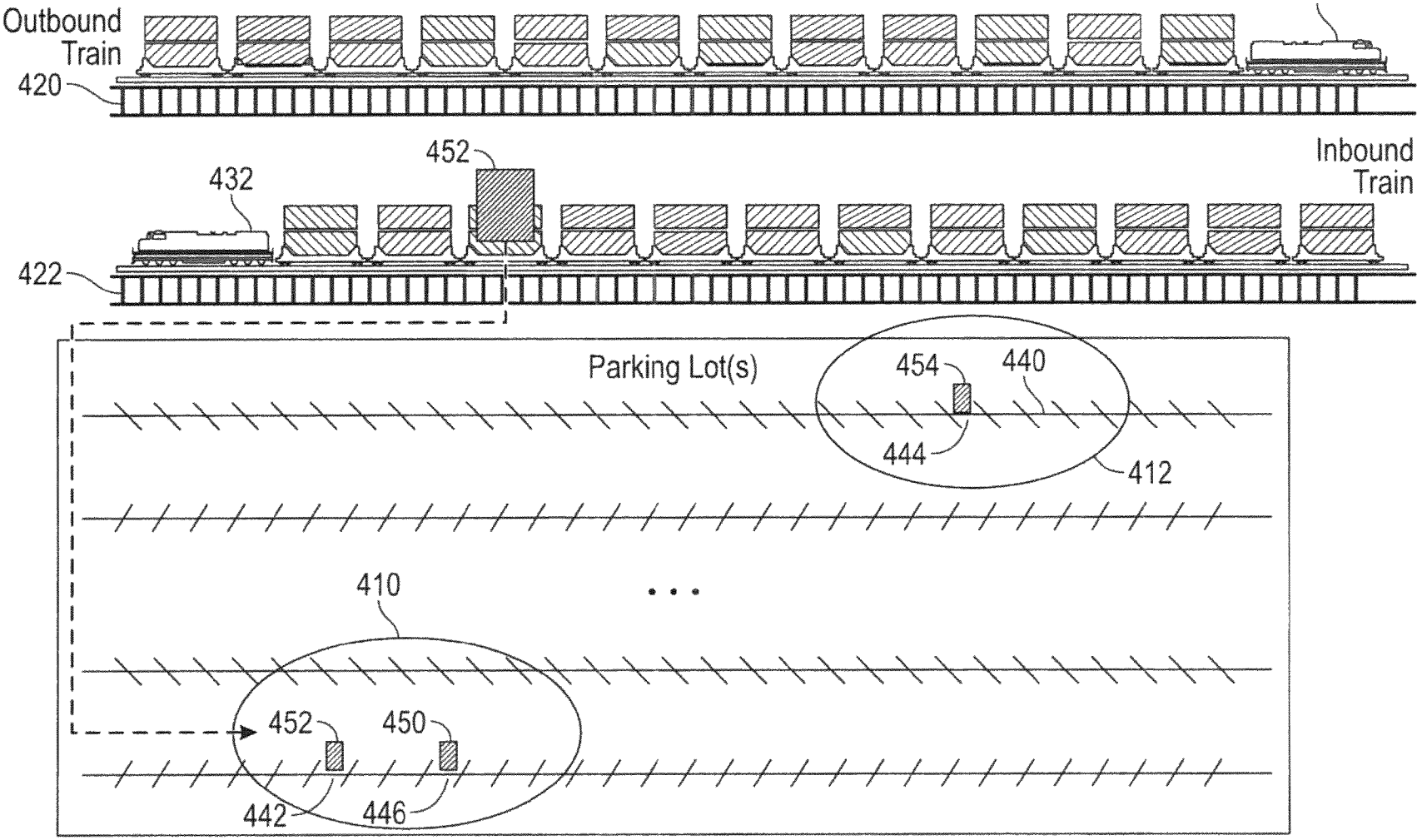
FIGS. 4A-4C illustrate operations in a hub to repair deviations in the execution of an optimized operating schedule associated with a hub in accordance with embodiments of the present disclosure.
Figure 4B:
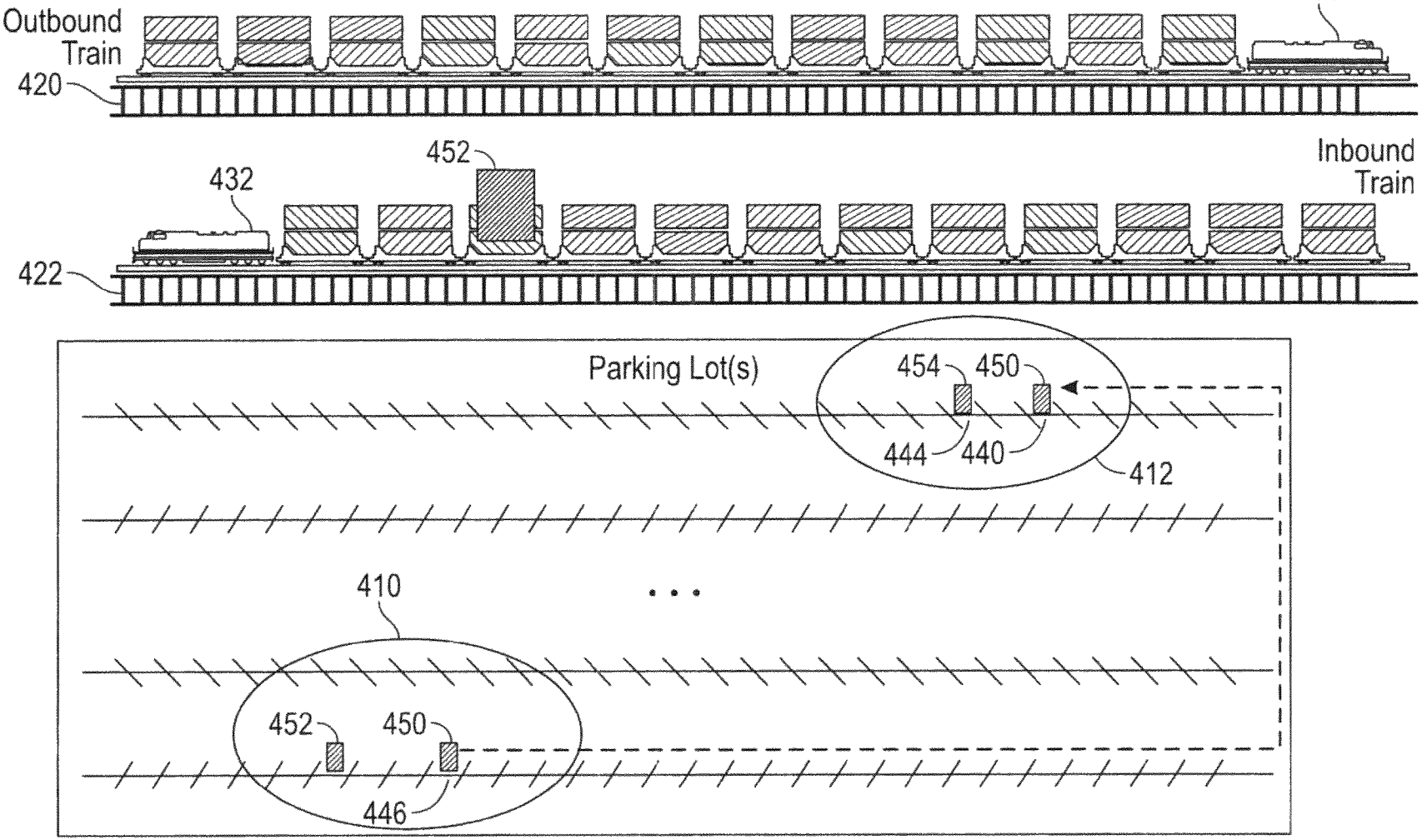
Figure 4C:
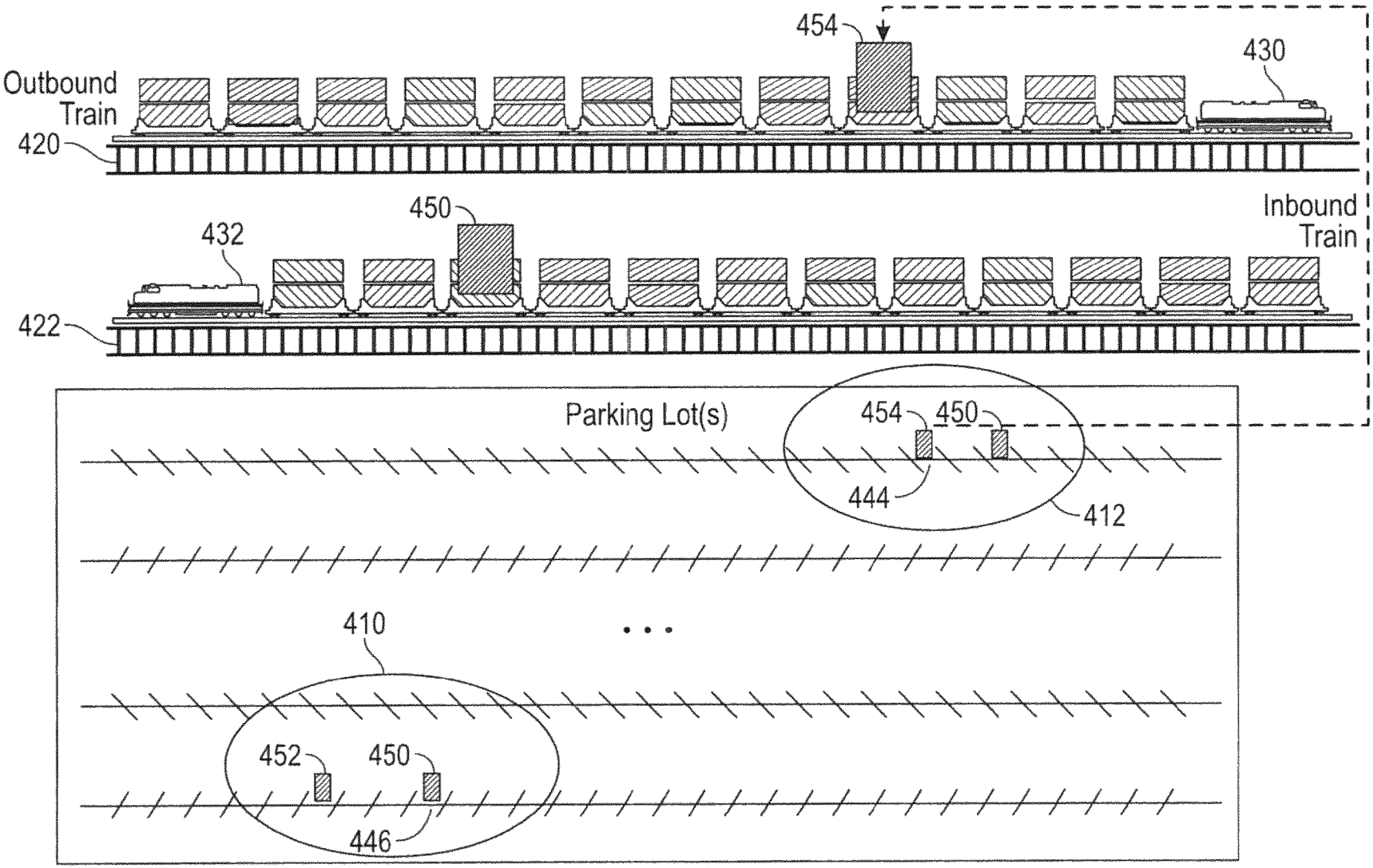

FIG. 3 is a flowchart illustrating operations of a multihop operations manager 126 to intelligently repair deviations in the execution of an optimized operating schedule associated with a hub in accordance with embodiments of the present disclosure. The operations illustrated in FIG. 3 will be discussed with further reference to FIGS. 4A-4C. FIGS. 4A-4C illustrate operations in a hub to repair deviations in the execution of an optimized operating schedule associated with a hub in accordance with embodiments of the present disclosure. In particular, the operations illustrated in FIGS. 3 and 4A-4C include operations of multihop operations manager 126 to generate and insert a multihop operation into linked hostler route operations (e.g., linked ramping hostler route operation and deramping hostler route operation) to move a mis-located unit from a first location (e.g., the currently mis-located parking spot) to an optimal location.

As shown in FIG. 3, operations of may start at block 302 where unit 450 may be received at the hub (e.g., hub 140 as illustrated in FIG. 1) from a customer during a time increment of the planning horizon of an optimized operating schedule associated with the hub currently being executed. It is noted that, upon unit 450 arriving at the hub, unit 450 is put under the direction and control of the operators of the hub. Unit 450, in this case, may be received as part of the IG flow or consolidation stream of the hub and may subsequently be loaded onto an outbound train to be transported to a destination. In the meantime, while unit 450 waits to be loaded onto the assigned outbound train, unit 450 may wait while parked or located in a parking spot of a parking lot of the hub. To this end, an operations server (e.g., operations server 125) may obtain, at block 304, the optimized operating schedule to determine how to process unit 450, and in particular to obtain parking lot recommendations that may recommend a parking lot category to allocated to unit 450 based on the dwell time of unit 450. At block 306, the operations server may obtain a parking spot assignment for unit 450, which may be based on the outbound train assignment for unit 450 (e.g., which may be based on active train schedules, etc.).

In this example, as shown in FIG. 4A, unit 450 may be parked in parking spot 446. However, in this example, placing unit 450 in parking spot 446 may represent a mis-location of unit 450, as this action may represent a deviation from the optimized operating schedule. This may be because, as described herein, parking spot 446 may not be the parking spot recommended by the optimized operating schedule or may be a parking spot that is not located in a parking lot category recommended by the optimized operating schedule (e.g., at block 306). In this case, the optimized operating schedule may have recommended a different parking lot category but the parking lots having the recommended parking lot category may not have capacity to receive unit 450, in which case the operations server assigned parking spot 446 to unit 450. In another example, the operations server may have assigned a different parking spot to unit 450, but the operator transporting unit 450 may have parked unit 450 in parking spot 446 by mistake or based on their decision-making. In still another example, the optimized operating schedule may indeed recommend parking spot 446 (or at least the parking lot category of the parking lot to which parking spot 446 belongs), but the operational environment on which the optimized operating schedule is based may have changed (e.g., trains may be delayed, hub resources may be depleted or may fail, etc.), rendering parking spot 446 no longer optimal (e.g., the expected unit throughput provided by the optimized operating schedule over the planning horizon may be negatively affected by parking unit 450 in parking spot 446).

At block 308, the operations servers may leverage the functionality of the multihop operations manager to determine that unit 450 is mis-located and at block 310 may determine the location of the mis-located unit (e.g., parking spot 446). Determining that unit 450 is mis-located in parking spot 446 may include determining that the unit throughput is not optimized with unit 450 located in parking spot 446, as described above.

At block 312, the multihop operations manager may determine an optimal location for unit 450. Determining the optimal location for unit 450 may include determining a location that may lead to a higher unit throughput for the hub over the planning horizon when unit 450 is parked or located therein than the unit throughput for the hub that may be obtained from unit 450 being located at parking spot 446. The optimal location may be the original location recommended by the optimized operating schedule, or may be a location calculated to yield a higher unit throughput over the planning horizon for the hub. In this example, the multihop operations manager may determine that parking spot 440 is an optimal location for unit 450. In this example, parking spot 440 may be located in a different parking lot category than parking lot 446 or may be in the same parking lot category. In this example, parking spot 440 may be closer to the production tracks (e.g., production track 420 or 422) on which the outbound train to which unit 450 may be assigned is to be consolidated. In this case, the proximity of parking spot 440 to the production tracks 420 and 422 makes an optimal parking spot for unit 450.

At block 314, the multihop operations manager may identify a deramp/ramp hostler route operations combination that may be suitable to support a multihop operation to transport unit 450 from parking spot 446 to parking spot 440. In particular, the multihop operations manager may identify a deramp hostler route operation having a route that may bring a hostler within threshold 410 of parking spot 446. In this example, the deramp hostler route operation may include deramping unit 452 from inbound train 432 on production track 422 and transporting unit 452 to its assigned parking spot 442. In this case, the hostler, when dropping off unit 452 in parking spot 442 may come within threshold 410 of parking spot 446. The multihop operations manager may also identify a ramp hostler route operation to be performed by the same hostler having a route that may bring the hostler within threshold 412 of parking spot 440 (e.g., the optimal location for unit 450). In this example, the ramp hostler route operation may include picking up unit 454 from parking spot 444 and transporting unit 454 to be loaded onto outbound train 430 on production track 420. In this case, the hostler, when picking up unit 454 from parking spot 444 may come within threshold 412 of parking spot 440. In this manner, the multihop operations manager may identify hostler route operations that may be suitable to support a multihop operation to move unit 450 from parking spot 446 to parking spot 440 while minimizing the impact to the deramp operation for unit 452 and the ramp operation for unit 454.

At block 316, the multihop operations manager may insert a multihop operation configured to cause the hostler (e.g., the hostler involved in the deramp/ramp hostler route operations combination identified at block 314) to transport unit 450 from parking spot 446 to parking spot 440 while performing the deramp/ramp hostler route operations combination. In particular, in this example, the multihop operations manager may generate a control signal configured to insert or sandwich a multihop workorder (e.g., a workorder for transporting unit 450 from parking spot 446 to parking spot 440) between the deramp workorder (e.g., the workorder for performing the deramp hostler route operation) and the ramp workorder (e.g., the workorder for performing the ramp hostler route operation). In this example the deramp workorder may be executed, then the multihop workorder, and finally the ramp workorder.

At block 318, during execution of the deramp hostler route operation (e.g., during the execution of the deramp workorder), as shown in FIG. 4A, the hostler may deramp (e.g., may unload) unit 452 from inbound train 432 and may transport unit 452 to parking spot 442. At block 320, unit 452 may be dropped off and parked at parking spot 442. The hostler may then begin execution of the multihop operation and may drive to parking spot 446, where mis-located unit 450 is currently parked. At block 322, the hostler may retrieve (e.g., may pick up) unit 450 from parking spot 446. As shown in FIG. 4B, the hostler may then transport or drive unit 450 to parking spot 440 and, at block 324, may drop off unit 450 in parking spot 440, which represents the optimal location for unit 450. At this time, the multihop operation for unit 450 is complete and the hostler may execute the ramp hostler route operation. The hostler may drive to parking spot 444 and may retrieve (e.g., may pick up) unit 454 from parking spot 444 at block 326. As shown in FIG. 4C, the hostler may drive or transport unit 454 from parking spot 444 to production track 420 where outbound train 430 may be located and may, at block 328, ramp or load unit 454 onto outbound train 430, ending the process at block 330. In this manner, hostler route operations may be leveraged to move unit 450 from the suboptimal parking spot 446 to the optimal parking spot 440 and repair the deviation from the optimized operating schedule while minimizing the impact to the hostler route operations to ensure a maximized or optimized unit throughput of the hub over the planning horizon.

Figure 5:
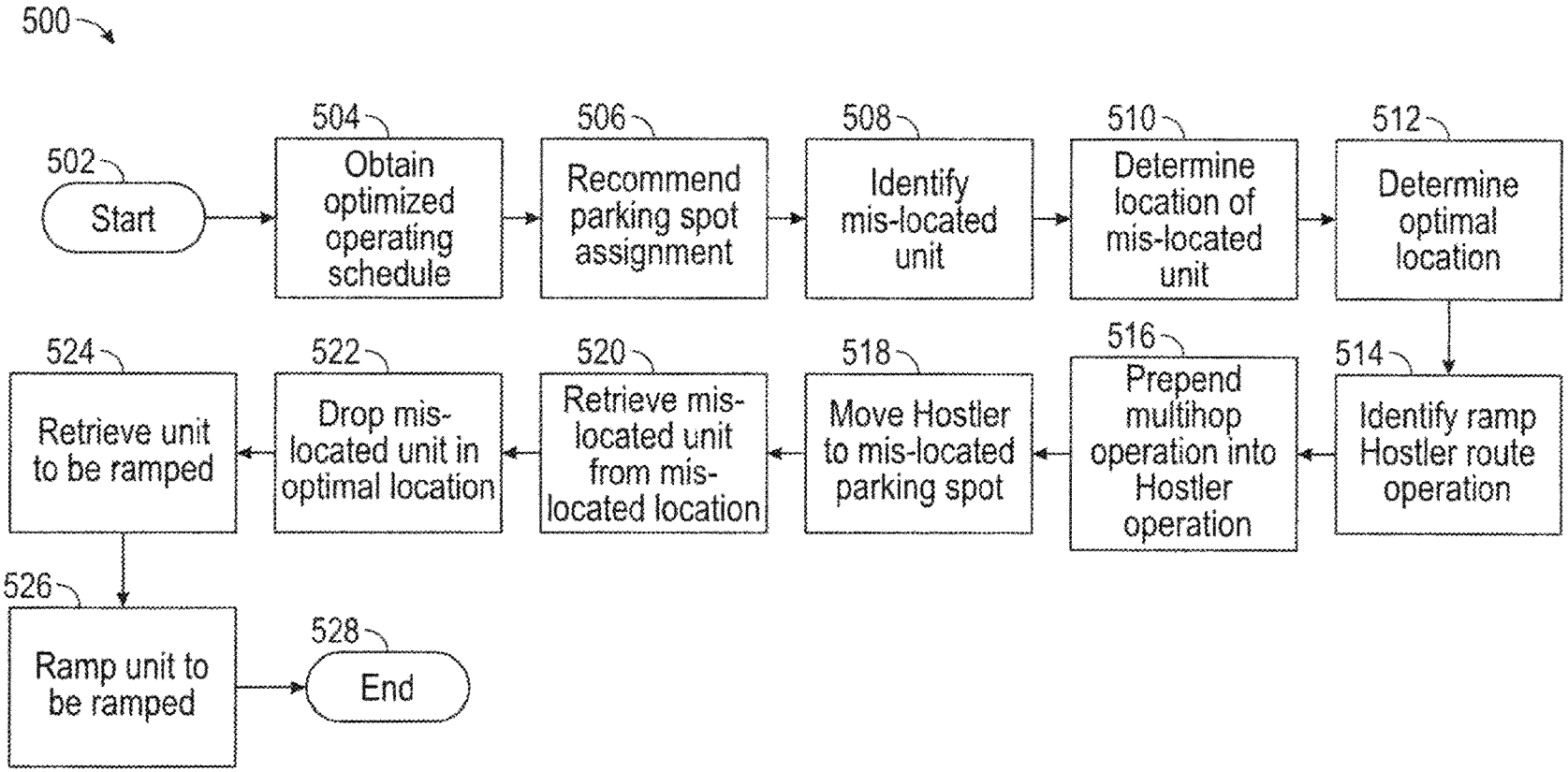
FIG. 5 is another flowchart illustrating operations of a multihop operations manager to intelligently repair deviations in the execution of an optimized operating schedule associated with a hub in accordance with embodiments of the present disclosure.
Figure 6A:
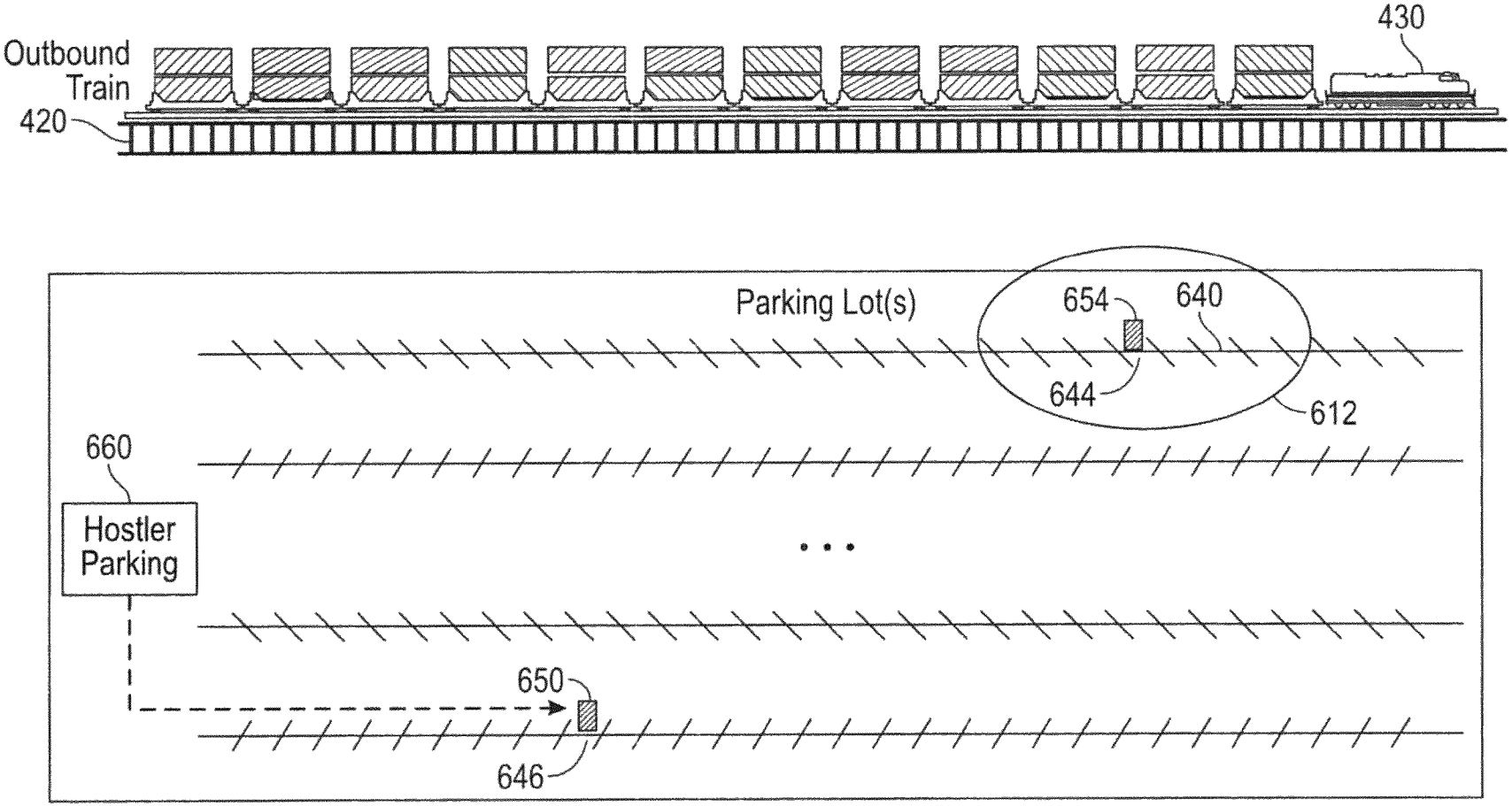
FIGS. 6A-6C illustrate operations in a hub to repair deviations in the execution of an optimized operating schedule associated with a hub in accordance with embodiments of the present disclosure.
Figure 6B:
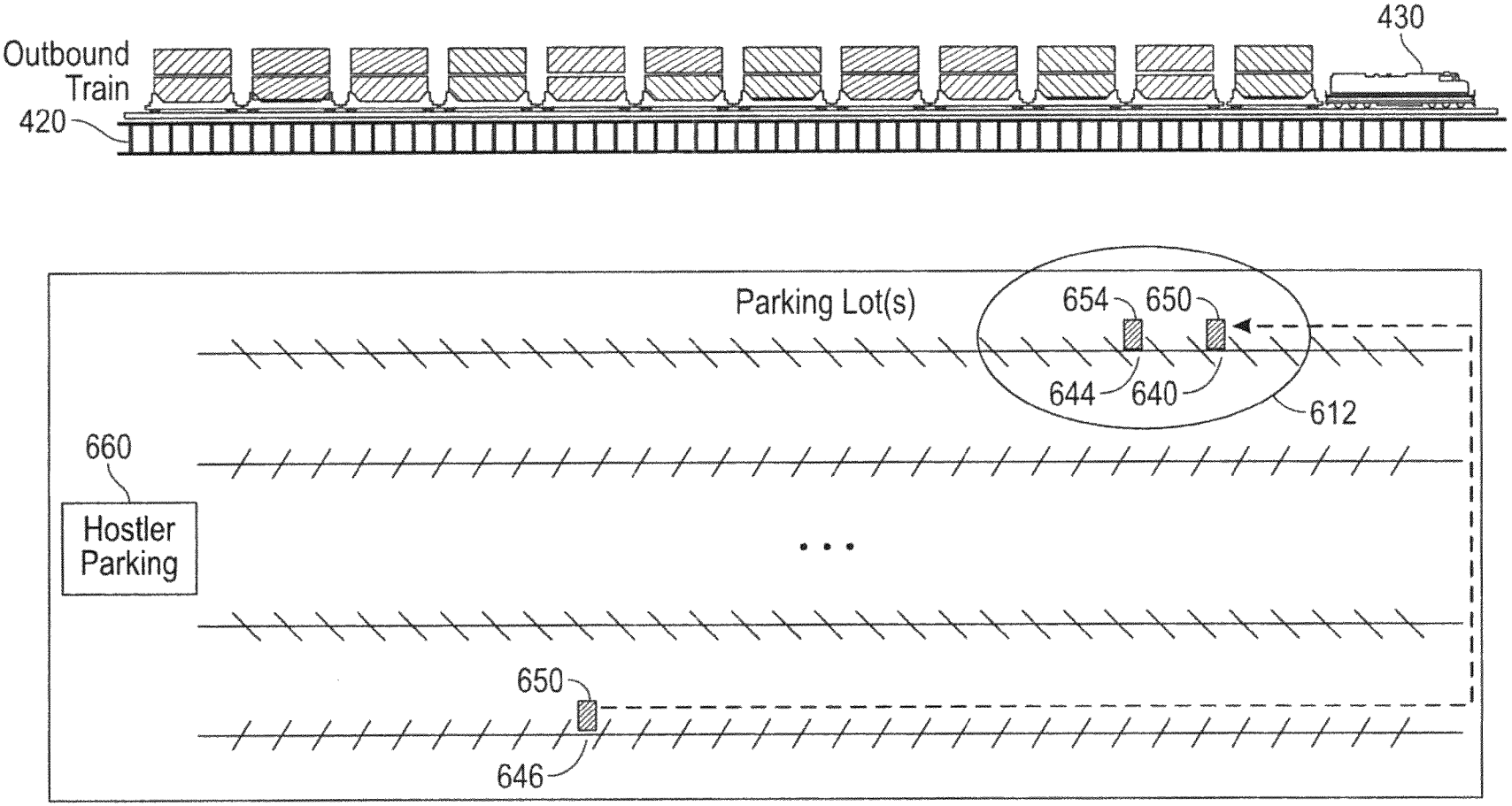
Figure 6C:
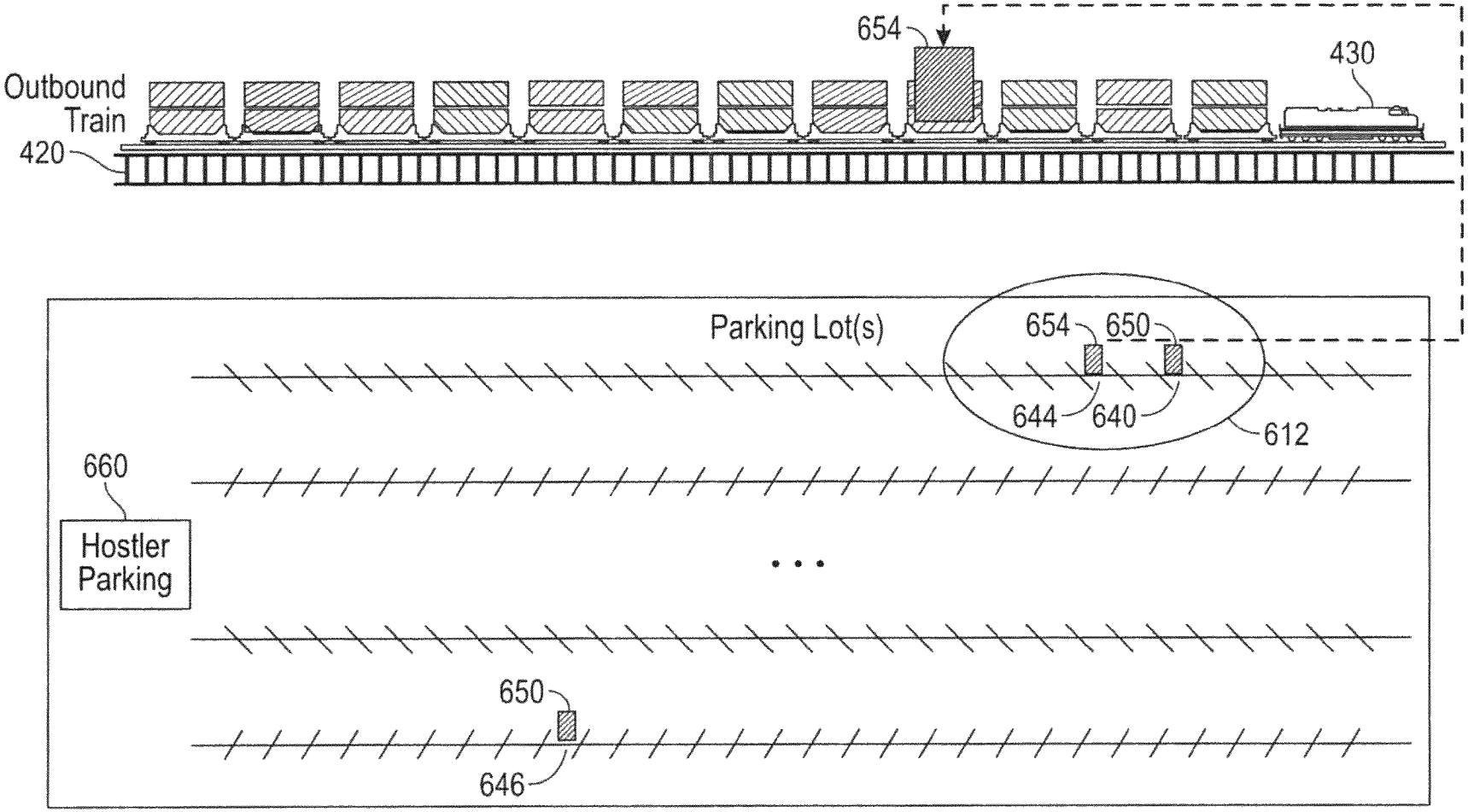

FIG. 5 is another flowchart illustrating operations of a multihop operations manager 126 to intelligently repair deviations in the execution of an optimized operating schedule associated with a hub in accordance with embodiments of the present disclosure. The operations illustrated in FIG. 5 will be discussed with further reference to FIGS. 6A-6C. FIGS. 6A-6C illustrate operations in a hub to repair deviations in the execution of an optimized operating schedule associated with a hub in accordance with embodiments of the present disclosure. In particular, the operations illustrated in FIGS. 5 and 6A-6C include operations of multihop operations manager 126 to generate and prepend a multihop operation into a ramping hostler route operation to move a mis-located unit from a first location (e.g., the currently mis-located parking spot) to an optimal location.

As shown in FIG. 5, operations of may start at block 502 where unit 650 may be received at the hub (e.g., hub 140 as illustrated in FIG. 1) from a customer during a time increment of the planning horizon of an optimized operating schedule associated with the hub currently being executed. It is noted that, upon unit 650 arriving at the hub, unit 650 is put under the direction and control of the operators of the hub. Unit 650, in this case, may be received as part of the IG flow or consolidation stream of the hub and may subsequently be loaded onto an outbound train to be transported to a destination. In the meantime, while unit 650 waits to be loaded onto the assigned outbound train, unit 650 may wait while parked or located in a parking spot of a parking lot of the hub. To this end, an operations server (e.g., operations server 125) may obtain, at block 504, the optimized operating schedule to determine how to process unit 650, and in particular to obtain parking lot recommendations that may recommend a parking lot category to allocated to unit 650 based on the dwell time of unit 650. At block 506, the operations server may obtain a parking spot assignment for unit 650, which may be based on the outbound train assignment for unit 650 (e.g., which may be based on active train schedules, etc.).

In this example, as shown in FIG. 6A, unit 650 may be parked in parking spot 646. However, in this example, placing unit 650 in parking spot 646 may represent a mis-location of unit 650, as this action may represent a deviation from the optimized operating schedule. This may be because, as described herein, parking spot 646 may not be the parking spot recommended by the optimized operating schedule or may be a parking spot that is not located in a parking lot category recommended by the optimized operating schedule (e.g., at block 506). In this case, the optimized operating schedule may have recommended a different parking lot category but the parking lots having the recommended parking lot category may not have capacity to receive unit 650, in which case the operations server assigned parking spot 646 to unit 650. In another example, the operations server may have assigned a different parking spot to unit 650, but the operator transporting unit 650 may have parked unit 650 in parking spot 646 by mistake or based on their decision-making. In still another example, the optimized operating schedule may indeed recommend parking spot 646 (or at least the parking lot category of the parking lot to which parking spot 646 belongs), but the operational environment on which the optimized operating schedule is based may have changed (e.g., trains may be delayed, hub resources may be depleted or may fail, etc.), rendering parking spot 646 no longer optimal (e.g., the expected unit throughput provided by the optimized operating schedule over the planning horizon may be negatively affected by parking unit 650 in parking spot 646).

At block 508, the operations servers may leverage the functionality of the multihop operations manager to determine that unit 650 is mis-located and at block 510 may determine the location of the mis-located unit (e.g., parking spot 646). Determining that unit 650 is mis-located in parking spot 446 may include determining that the unit throughput is not optimized with unit 650 located in parking spot 646, as described above.

At block 512, the multihop operations manager may determine an optimal location for unit 650. Determining the optimal location for unit 650 may include determining a location that may lead to a higher unit throughput for the hub over the planning horizon when unit 650 is parked or located therein than the unit throughput for the hub that may be obtained from unit 650 being located at parking spot 646. The optimal location may be the original location recommended by the optimized operating schedule, or may be a location calculated to yield a higher unit throughput over the planning horizon for the hub. In this example, the multihop operations manager may determine that parking spot 640 is an optimal location for unit 650. In this example, parking spot 640 may be located in a different parking lot category than parking lot 646 or may be in the same parking lot category. In this example, parking spot 640 may be closer to the production tracks on which the outbound train to which unit 650 may be assigned is to be consolidated. In this case, the proximity of parking spot 640 to the production tracks makes an optimal parking spot for unit 650.

At block 514, the multihop operations manager may identify a ramp hostler route operation that may be suitable to support a multihop operation to transport unit 650 from parking spot 646 to parking spot 640. In particular, the multihop operations manager may identify a ramp hostler route operation to be performed by a hostler having a route that may bring the hostler within threshold 412 of parking spot 640 (e.g., the optimal location for unit 650). In this example, the ramp hostler route operation may include picking up unit 654 from parking spot 644 and transporting unit 654 to be loaded onto outbound train 430 on production track 420. In this case, the hostler, when picking up unit 646 from parking spot 644 may come within threshold 612 of parking spot 640. In this manner, the multihop operations manager may identify a hostler route operation that may be suitable to support a multihop operation to move unit 650 from parking spot 646 to parking spot 640 while minimizing the impact to the ramp operation for unit 654.

At block 516, the multihop operations manager may prepend a multihop operation configured to cause the hostler (e.g., the hostler involved in the ramp hostler route operation identified at block 514) to transport unit 650 from parking spot 646 to parking spot 640 while performing the ramp hostler route operation. In particular, in this example, the multihop operations manager may generate a control signal configured to prepend a multihop workorder (e.g., a workorder for transporting unit 650 from parking spot 646 to parking spot 640) to the ramp workorder (e.g., the workorder for performing the ramp hostler route operation). In this example the multihop workorder may be performed first, and then the ramp workorder may be performed.

At block 518, as shown in FIG. 6A, the hostler may begin execution of the multihop operation and may drive to parking spot 646, where mis-located unit 650 is currently parked. At block 520, the hostler may retrieve (e.g., may pick up) unit 650 from parking spot 646. As shown in FIG. 6B, the hostler may then transport or drive unit 650 to parking spot 640 and, at block 522, may drop off unit 650 in parking spot 640, which represents the optimal location for unit 650. At this time, the multihop operation for unit 650 is complete and the hostler may execute the ramp hostler route operation. The hostler may drive to parking spot 644 and at block 524 may retrieve (e.g., may pick up) unit 654 from parking spot 644. As shown in FIG. 4C, the hostler may drive or transport unit 654 from parking spot 644 to production track 420 where outbound train 430 may be located and may, at block 526, ramp or load unit 654 onto outbound train 430, ending the process at block 528. In this manner, hostler route operations may be leveraged to move unit 650 from the suboptimal parking spot 646 to the optimal parking spot 640 and repair the deviation from the optimized operating schedule while minimizing the impact to the hostler route operations to ensure a maximized or optimized unit throughput of the hub over the planning horizon.

Figure 7:
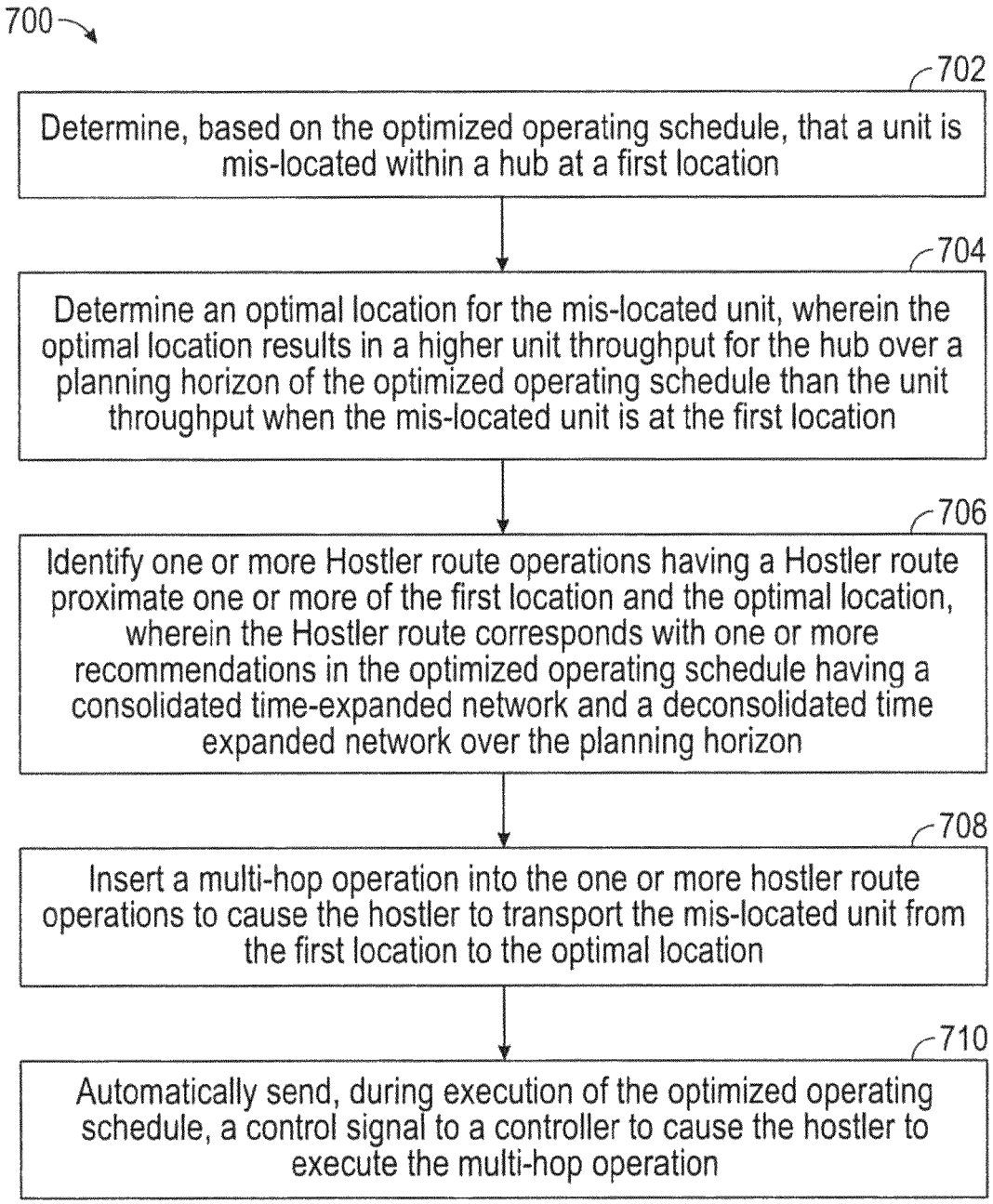
FIG. 7 is a flowchart illustrating operations for intelligently repairing deviations in the execution of an optimized operating schedule associated with a hub in accordance with embodiments of the present disclosure.

FIG. 7 shows a high-level flow diagram 700 of operation of a system configured for providing functionality for intelligently repairing deviations in the execution of an optimized operating schedule associated with a hub in accordance with embodiments of the present disclosure. For example, the functions illustrated in the example blocks shown in FIG. 7 may be performed by system 100 of FIG. 1 according to embodiments herein. In embodiments, the operations of the method 700 may be stored as instructions that, when executed by one or more processors, cause the one or more processors to perform the operations of the method 700.

At block 702, a determination is made, based on an optimized operating schedule that a unit is mis-located within a hub at a first location. In embodiments, functionality of a multihop operations manager (e.g., multihop operations manager 126 as illustrated in FIG. 2) may be used to determine, based on the optimized operating schedule, that a unit is mis-located within a hub at a first location. In embodiments, the multihop operations manager may perform operations to determine, based on the optimized operating schedule, that a unit is mis-located within a hub at a first location according to operations and functionality as described above with reference to multihop operations manager 126 and as illustrated in FIGS. 1-6C.

At block 704, an optimal location for the mis-located unit is determined. In embodiments, the optimal location results in a higher unit throughput for the hub over a planning horizon of the optimized operating schedule than the unit throughput when the mis-located unit is at the first location. In embodiments, functionality of a multihop operations manager (e.g., multihop operations manager 126 as illustrated in FIG. 2) may be used to determine an optimal location for the mis-located unit. In embodiments, the multihop operations manager may perform operations to determine an optimal location for the mis-located unit according to operations and functionality as described above with reference to multihop operations manager 126 and as illustrated in FIGS. 1-6C.

At block 706, one or more hostler route operations having a hostler route proximate one or more of the first location and the optimal location are identified. In embodiments, the hostler route corresponds with one or more recommendations in the optimized operating schedule having a consolidated time-expanded network and a deconsolidated time-expanded network over the planning horizon. In embodiments, functionality of a multihop operations manager (e.g., multihop operations manager 126 as illustrated in FIG. 2) may be used to identify a hostler route operation having a hostler route proximate the first location and the optimal location. In embodiments, the multihop operations manager may perform operations to identify a hostler route operation having a hostler route proximate the first location and the optimal location according to operations and functionality as described above with reference to multihop operations manager 126 and as illustrated in FIGS. 1-6C.

At block 708, a multi-hop operation is inserted into the one or more hostler route operations to cause the hostler to transport the mis-located unit from the first location to the optimal location. In embodiments, functionality of a multi-hop operations manager (e.g., multihop operations manager 126 as illustrated in FIG. 2) may be used to insert a multi-hop operation into the hostler route operation to cause the hostler to transport the mis-located unit from the first location to the optimal location. In embodiments, the multihop operations manager may perform operations to insert a multi-hop operation into the hostler route operation to cause the hostler to transport the mis-located unit from the first location to the optimal location according to operations and functionality as described above with reference to multihop operations manager 126 and as illustrated in FIGS. 1-6C.

At block 710, a control signal is automatically sent to a controller to cause the hostler to execute the multi-hop operation. In embodiments, functionality of an operations server (e.g., operations server 125 as illustrated in FIGS. 1-3) may be used automatically send, during execution of the optimized operating schedule, a control signal to a controller to cause the hostler to execute the multi-hop operation. In embodiments, the operations server may perform operations to automatically send, during execution of the optimized operating schedule, a control signal to a controller to cause the hostler to execute the multi-hop operation according to operations and functionality as described above with reference to operations server 125 and as illustrated in FIGS. 1-6C.

Persons skilled in the art will readily understand that advantages and objectives described above would not be possible without the particular combination of computer hardware and other structural components and mechanisms assembled in this inventive system and described herein. Additionally, the algorithms, methods, and processes disclosed herein improve and transform any general-purpose computer or processor disclosed in this specification and drawings into a special purpose computer programmed to perform the disclosed algorithms, methods, and processes to achieve the aforementioned functionality, advantages, and objectives. It will be further understood that a variety of programming tools, known to persons skilled in the art, are available for generating and implementing the features and operations described in the foregoing. Moreover, the particular choice of programming tool(s) may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosure can be established by the appended claims. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

Those of skill in the art would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. Skilled artisans will also readily recognize that the order or combination of components, methods, or interactions that are described herein are merely examples and that the components, methods, or interactions of the various embodiments of the present disclosure may be combined or performed in ways other than those illustrated and described herein.

Functional blocks and modules in FIGS. 1-7 may comprise processors, electronics devices, hardware devices, electronics components, logical circuits, memories, software codes, firmware codes, etc., or any combination thereof. Consistent with the foregoing, various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal, base station, a sensor, or any other communication device. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. Computer-readable storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, a connection may be properly termed a computer-readable medium. For example, if the software is transmitted from a website, server, or other remote source using a coaxial cable, fiber optic cable, twisted pair, or digital subscriber line (DSL), then the coaxial cable, fiber optic cable, twisted pair, or DSL, are included in the definition of medium. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method of intelligently repairing deviations in the execution of an optimized operating schedule associated with a hub, comprising:

determining, based on the optimized operating schedule, that a unit is mis-located within a hub at a first location;

determining an optimal location for the mis-located unit, wherein the optimal location results in a higher unit throughput for the hub over a planning horizon of the optimized operating schedule than a unit throughput when the mis-located unit is at the first location;

identifying one or more hostler route operations having a hostler route proximate one or more of the first location and the optimal location, wherein the hostler route corresponds with one or more recommendations in the optimized operating schedule having a consolidated time-expanded network and a deconsolidated time-expanded network over the planning horizon;

inserting a multi-hop operation into the one or more hostler route operations to cause the hostler to transport the mis-located unit from the first location to the optimal location; and automatically sending, during execution of the optimized operating schedule, a control signal to a controller to cause the hostler to execute the multi-hop operation.

2. The method of claim 1, wherein determining that the unit is mis-located within the hub at the first location includes determining that the mis-located unit located in the first location is inconsistent with the optimized operating schedule.

3. The method of claim 2, wherein determining that the mis-located unit located in the first location is inconsistent with the optimized operating schedule includes one or more of:

determining that the first location is located within a parking lot having a parking lot category different from the parking lot category recommended by the optimized operating schedule for the mis-located unit; and determining that an operational environment of the hub has changed rendering the first location no longer optimal to maximize the unit throughput of the hub over the planning horizon.

4. The method of claim 1, wherein the optimal location for the mis-located unit includes one or more of:

a location originally recommended by the optimized operating schedule; and a location calculated to lead to the higher unit throughput for the hub over a planning horizon of the optimized operating schedule.

5. The method of claim 1, wherein determining that the hostler route is proximate one or more of the first location and the optimal location includes:

determining whether the hostler route of the one or more hostler route operations causes a hostler involved in the one or more hostler route operations to pass within one or more of a first threshold distance of the first location and a second threshold distance of the optimal location.

6. The method of claim 1, wherein the one or more hostler route operations include:

a deramp hostler route operation configured to move a deramped unit from an inbound train to a deramp location located within the first threshold distance of the first location;

a ramp hostler route operation configured to move a ramped unit from a ramp location located within the second threshold distance of the optimal location to an outbound train.

7. The method of claim 6, wherein inserting the multi-hop operation into the one or more hostler route operations includes inserting the multi-hop operation between the deramp hostler route operation and the ramp hostler route operation such that during execution of the one or more hostler route operations the deramp hostler route operation is performed, followed by the multi-hop operation, then followed by the ramp hostler route operation.

8. The method of claim 1, wherein the first location is a first parking spot in a first parking lot having a first parking lot category, and wherein the optimal location is a second parking spot in a second parking lot having a second parking lot category.

9. A system configured for intelligently repairing deviations in the execution of an optimized operating schedule associated with a hub, comprising:

at least one processor; and a memory operably coupled to the at least one processor and storing processor-readable code that, when executed by the at least one processor, is configured to perform operations including:

determining, based on the optimized operating schedule, that a unit is mis-located within a hub at a first location;

determining an optimal location for the mis-located unit, wherein the optimal location results in a higher unit throughput for the hub over a planning horizon of the optimized operating schedule than a unit throughput when the mis-located unit is at the first location;

identifying one or more hostler route operations having a hostler route proximate one or more of the first location and the optimal location, wherein the hostler route corresponds with one or more recommendations in the optimized operating schedule having a consolidated time-expanded network and a deconsolidated time-expanded network over the planning horizon;

inserting a multi-hop operation into the one or more hostler route operations to cause the hostler to transport the mis-located unit from the first location to the optimal location; and automatically sending, during execution of the optimized operating schedule, a control signal to a controller to cause the hostler to execute the multi-hop operation.

10. The system of claim 9, wherein determining that the unit is mis-located within the hub at the first location includes determining that the mis-located unit located in the first location is inconsistent with the optimized operating schedule.

11. The system of claim 10, wherein determining that the mis-located unit located in the first location is inconsistent with the optimized operating schedule includes one or more of:

determining that the first location is located within a parking lot having a parking lot category different from the parking lot category recommended by the optimized operating schedule for the mis-located unit; and determining that an operational environment of the hub has changed rendering the first location no longer optimal to maximize the unit throughput of the hub over the planning horizon.

12. The system of claim 9, wherein the optimal location for the mis-located unit includes one or more of:

a location originally recommended by the optimized operating schedule; and a location calculated to lead to the higher unit throughput for the hub over a planning horizon of the optimized operating schedule.

13. The system of claim 9, wherein determining that the hostler route is proximate one or more of the first location and the optimal location includes:

determining whether the hostler route of the one or more hostler route operations causes a hostler involved in the one or more hostler route operations to pass within one or more of a first threshold distance of the first location and a second threshold distance of the optimal location.

14. The system of claim 9, wherein the one or more hostler route operations include:

a deramp hostler route operation configured to move a deramped unit from an inbound train to a deramp location located within the first threshold distance of the first location;

a ramp hostler route operation configured to move a ramped unit from a ramp location located within the second threshold distance of the optimal location to an outbound train.

15. The system of claim 14, wherein inserting the multi-hop operation into the one or more hostler route operations includes inserting the multi-hop operation between the deramp hostler route operation and the ramp hostler route operation such that during execution of the one or more hostler route operations the deramp hostler route operation is performed, followed by the multi-hop operation, then followed by the ramp hostler route operation.

16. The system of claim 9, wherein the first location is a first parking spot in a first parking lot having a first parking lot category, and wherein the optimal location is a second parking spot in a second parking lot having a second parking lot category.

17. A computer-based tool for intelligently repairing deviations in the execution of an optimized operating schedule associated with a hub, the computer-based tool including non-transitory computer readable media having stored thereon computer code which, when executed by a processor, causes a computing device to perform operations comprising:

determining, based on the optimized operating schedule, that a unit is mis-located within a hub at a first location;

determining an optimal location for the mis-located unit, wherein the optimal location results in a higher unit throughput for the hub over a planning horizon of the optimized operating schedule than a unit throughput when the mis-located unit is at the first location;

identifying one or more hostler route operations having a hostler route proximate one or more of the first location and the optimal location, wherein the hostler route corresponds with one or more recommendations in the optimized operating schedule having a consolidated time-expanded network and a deconsolidated time-expanded network over the planning horizon;

inserting a multi-hop operation into the one or more hostler route operations to cause the hostler to transport the mis-located unit from the first location to the optimal location; and automatically sending, during execution of the optimized operating schedule, a control signal to a controller to cause the hostler to execute the multi-hop operation.

18. The computer-based tool of claim 17, wherein determining that the unit is mis-located within the hub at the first location includes determining that the mis-located unit located in the first location is inconsistent with the optimized operating schedule.

19. The computer-based tool of claim 18, wherein determining that the mis-located unit located in the first location is inconsistent with the optimized operating schedule includes one or more of:

determining that the first location is located within a parking lot having a parking lot category different from the parking lot category recommended by the optimized operating schedule for the mis-located unit; and determining that an operational environment of the hub has changed rendering the first location no longer optimal to maximize the unit throughput of the hub over the planning horizon.

20. The computer-based tool of claim 17, wherein determining that the hostler route is proximate one or more of the first location and the optimal location includes:

determining whether the hostler route of the one or more hostler route operations causes a hostler involved in the one or more hostler route operations to pass within one or more of a first threshold distance of the first location and a second threshold distance of the optimal location.

* * * * *